US011946111B2

(12) United States Patent
Minami et al.

(10) Patent No.: US 11,946,111 B2
(45) Date of Patent: *Apr. 2, 2024

(54) STEEL SHEET, COATED STEEL SHEET, METHOD FOR PRODUCING HOT-ROLLED STEEL SHEET, METHOD FOR PRODUCING COLD-ROLLED FULL HARD STEEL SHEET, METHOD FOR PRODUCING HEAT-TREATED STEEL SHEET, METHOD FOR PRODUCING STEEL SHEET, AND METHOD FOR PRODUCING COATED STEEL SHEET

(71) Applicant: JFE Steel Corporation, Tokyo (JP)

(72) Inventors: Hidekazu Minami, Tokyo (JP); Yoshimasa Funakawa, Tokyo (JP); Shinjiro Kaneko, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 196 days.

This patent is subject to a terminal disclaimer.

(21) Appl. No.: 16/086,044

(22) PCT Filed: Mar. 7, 2017

(86) PCT No.: PCT/JP2017/008958

§ 371 (c)(1),
(2) Date: Sep. 18, 2018

(87) PCT Pub. No.: WO2017/169562

PCT Pub. Date: Oct. 5, 2017

(65) Prior Publication Data

US 2020/0248280 A1 Aug. 6, 2020

(30) Foreign Application Priority Data

Mar. 31, 2016 (JP) ..... 2016-070750
Nov. 30, 2016 (JP) ..... 2016-232544

(51) Int. Cl.
*C21D 8/02* (2006.01)
*C22C 38/00* (2006.01)
(Continued)

(52) U.S. Cl.
CPC ..... *C21D 8/0226* (2013.01); *C21D 8/0236* (2013.01); *C21D 8/0247* (2013.01); *C22C 38/001* (2013.01); *C22C 38/002* (2013.01); *C22C 38/02* (2013.01); *C22C 38/42* (2013.01); *C22C 38/44* (2013.01); *C22C 38/46* (2013.01); *C22C 38/48* (2013.01); *C22C 38/50* (2013.01);
(Continued)

(58) Field of Classification Search
CPC .. C21D 8/0226; C21D 8/0236; C21D 8/0263; C21D 8/0273; C21D 9/46; C21D 9/48; C21D 9/50; C21D 2211/005; C21D 2211/008; C21D 2211/00; C21D 2211/002; C21D 2211/004; C21D 2211/009; C21D 2201/03; C21D 2201/05; C21D 8/0205; C21D 8/0247; C21D 8/0463; C21D 8/0426; C21D 8/0436; C21D 8/0473; C21D 8/0221; C21D 8/04; C21D 8/00; C21D 8/0405; C21D 8/0278; C21D 8/0421; C21D 8/005; C21D 8/02; C21D 8/0257; C21D 8/0447; C21D 8/021; C21D 6/005; C21D 6/008; C21D 1/25; C21D 6/002; C21D 6/004; C21D 1/185; C21D 1/20; C21D 6/001; C21D 6/007; C21D 1/76; C21D 7/02; C21D 7/13; C23C 2/28; C23C 2/02; C23C 2/40; C23C 2/12; C23C 2/26; C23C 2/00; C23C 2/04; C23C 30/005; C23C 2/285; C23C 30/00
See application file for complete search history.

(56) References Cited

U.S. PATENT DOCUMENTS

2007/0144633 A1* 6/2007 Kizu ..... C22C 38/14 148/603
2011/0209800 A1 9/2011 Kim et al.
(Continued)

FOREIGN PATENT DOCUMENTS

CA 2082807 A1 * 9/1992 ..... C22C 38/14
EP 2407572 A1 1/2012
(Continued)

OTHER PUBLICATIONS

Total Materia; "Nitrogen in Steels: Part One"; retrieved Mar. 17, 2021; Date originally published Jun. 2007 (Year: 2007).*
(Continued)

*Primary Examiner* — Alexandra M Moore
*Assistant Examiner* — Austin Pollock
(74) *Attorney, Agent, or Firm* — Buchanan Ingersoll & Rooney, PC

(57) ABSTRACT

A steel sheet is provided, having a tensile strength of 590 MPa or more, a particular composition and a steel structure that contains, in terms of area fraction, particular amounts of ferrite and martensite, in which the ferrite average crystal grain size is 20 μm or less, the martensite average size is 15 μm or less, the ratio of the average crystal grain size of the ferrite to the average size of the martensite (ferrite average crystal grain size/martensite average size) is 0.5 to 10.0, the ratio of the hardness of the martensite to the hardness of the ferrite (martensite hardness/ferrite hardness) is 1.0 or more and 5.0 or less, and, in the texture of the ferrite, the inverse intensity ratio of γ-fiber to the α-fiber is 0.8 or more and 7.0 or less.

22 Claims, No Drawings

(51) Int. Cl.

| | |
|---|---|
| ***C22C 38/02*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C23C 2/02*** | (2006.01) |
| ***C23C 2/28*** | (2006.01) |

(52) U.S. Cl.

CPC ..... *C22C 38/52* (2013.01); *C22C 38/54* (2013.01); *C23C 2/02* (2013.01); *C23C 2/0224* (2022.08); *C23C 2/024* (2022.08); *C23C 2/28* (2013.01); *C21D 2211/005* (2013.01); *C21D 2211/008* (2013.01)

(56) References Cited

U.S. PATENT DOCUMENTS

| | | | | |
|---|---|---|---|---|
| 2012/0090737 | A1 | 4/2012 | Fushiwaki et al. | |
| 2012/0118439 | A1* | 5/2012 | Ono | C22C 38/22 148/533 |
| 2012/0180909 | A1* | 7/2012 | Ono | C21D 8/0236 148/504 |
| 2014/0102596 | A1* | 4/2014 | Ono | C22C 38/06 148/504 |
| 2014/0193667 | A1 | 7/2014 | Shuto et al. | |
| 2015/0017472 | A1 | 1/2015 | Kimura et al. | |
| 2015/0047751 | A1* | 2/2015 | Ono | C22C 38/60 148/504 |
| 2016/0186283 | A1 | 6/2016 | Minami et al. | |
| 2016/0186299 | A1 | 6/2016 | Minami et al. | |
| 2017/0152580 | A1 | 6/2017 | Kimura et al. | |
| 2017/0253944 | A1* | 9/2017 | Sakakibara | C22C 38/002 |

FOREIGN PATENT DOCUMENTS

| | | | | | |
|---|---|---|---|---|---|
| EP | 2623629 | A1 | | 8/2013 | |
| EP | 2636762 | A1 | | 9/2013 | |
| EP | 2738274 | A1 | | 6/2014 | |
| EP | 2767604 | A1 | | 8/2014 | |
| EP | 2811047 | A1 | | 12/2014 | |
| JP | 58022332 | A | | 2/1983 | |
| JP | 05005156 | A | * | 1/1993 | C22C 38/14 |
| JP | H-1192859 | A | * | 4/1999 | |
| JP | 2000212686 | A | * | 8/2000 | |
| JP | 2002241897 | A | * | 8/2002 | C21D 8/0205 |
| JP | 2004124123 | A | | 4/2004 | |
| JP | 2006152362 | A | | 6/2006 | |
| JP | 2006233294 | A | * | 9/2006 | |
| JP | 2007302918 | A | * | 11/2007 | |
| JP | 2010126747 | A | | 6/2010 | |
| JP | 2010126747 | A | * | 6/2010 | |
| JP | 2010255100 | A | | 11/2010 | |
| JP | 2011046999 | A | * | 3/2011 | |
| JP | 2012077377 | A | * | 4/2012 | C22C 38/14 |
| JP | 2013177673 | A | | 9/2013 | |
| JP | 2013216936 | A | * | 10/2013 | |
| JP | 5884210 | B1 | | 3/2016 | |
| KR | 20100075381 | A | * | 7/2010 | |
| KR | 20130094325 | A | | 8/2013 | |
| WO | 2013015428 | A1 | | 1/2013 | |
| WO | WO-2014097559 | A1 | * | 6/2014 | C21D 8/0205 |
| WO | 2015015738 | A1 | | 2/2015 | |
| WO | 2015015739 | A1 | | 2/2015 | |
| WO | WO-2015015739 | A1 | * | 2/2015 | C22C 38/16 |

OTHER PUBLICATIONS

Extended European Search Report for European Application No. 17 774 107.1, dated Feb. 20, 2019, 12 pages.

European Communication pursuant to Article 94(3) for European Application No. 17 774 107.1, dated Oct. 7, 2019, 5 pages.

Chinese Office Action with Search Report for Chinese Application No. 201780020179.9, dated Dec. 27, 2019, 12 pages.

Korean Office Action for Korean Application No. 10-2018-7028064, dated Oct. 30, 2019, with Concise Statement of Relevance of Office Action, 8 pages.

Korean Office Action for Korean Application No. 10-2018-7028064, dated Apr. 14, 2020, with Concise Statement of Relevance of Office Action, 5 pages.

Non Final Office Action for U.S. Appl. No. 16/089,051, dated Aug. 13, 2020, 13 pages.

International Search Report and Written Opinion for International Application No. PCT/JP2017/008958, dated Jun. 13, 2017—9 pages.

Non Final Office Action for U.S. Appl. No. 16/086,431, dated Oct. 21, 2020, 13 pages.

Final Office Action for U.S. Appl. No. 16/089,051, dated Mar. 10, 2021, 21 pages.

Non Final Office Action for U.S. Appl. No. 16/089,051, dated Jul. 22, 2021, 16 pages.

* cited by examiner

STEEL SHEET, COATED STEEL SHEET, METHOD FOR PRODUCING HOT-ROLLED STEEL SHEET, METHOD FOR PRODUCING COLD-ROLLED FULL HARD STEEL SHEET, METHOD FOR PRODUCING HEAT-TREATED STEEL SHEET, METHOD FOR PRODUCING STEEL SHEET, AND METHOD FOR PRODUCING COATED STEEL SHEET

CROSS REFERENCE TO RELATED APPLICATIONS

This is the U.S. National Phase application of PCT/JP2017/008958, filed Mar. 7, 2017, which claims priority to Japanese Patent Application No. 2016-070750, filed Mar. 31, 2016 and Japanese Patent Application No. 2016-232544, filed Nov. 30, 2016, the disclosures of each of these applications being incorporated herein by reference in their entireties for all purposes.

FIELD OF THE INVENTION

The present invention relates to a steel sheet, a coated steel sheet, a method for producing a hot-rolled steel sheet, a method for producing a cold-rolled full hard steel sheet, a method for producing a heat-treated steel sheet, a method for producing a steel sheet, and a method for producing a coated steel sheet. The steel sheets etc., of the present invention are suitable for use in structural elements, such as automobile parts.

BACKGROUND OF THE INVENTION

The rise in consciousness of global environmental protection in recent years has strongly urged improvements be made in fuel efficiency to reduce the $CO_2$ emission from automobiles. Under such trends, there has been increasing activity towards increasing the strength of the automobile body material to achieve thickness reduction and weight reduction of automobile bodies. However, increasing the strength of steel sheets poses a risk of degrading ductility. Thus, development of high-strength, high-ductility steel sheets is anticipated. Moreover, increasing the strength of and decreasing the thickness of steel sheets significantly degrade shape fixability. To address this issue, it has been a widespread practice to forecast in advance the change in shape after demolding and to design the mold at the time of press-forming by taking into account the amount of change in shape. However, once the yield stress (YP) of a steel sheet changes, there occurs a large deviation from the amount anticipated from the presumption that the yield stress is constant, shape defects are generated, and correction, such as sheet-metal-working of shapes of individual pieces after press-forming becomes necessary, thereby significantly degrading the mass production efficiency. Thus, variation in YP of steel sheets needs to be minimized.

To improve the ductility of high-strength cold-rolled steel sheets and high-strength galvanized steel sheets, there have been developed a variety of multi-phase high-strength steel sheets, such as ferrite-martensite dual phase steel (Dual-phase steel) and TRIP steel that utilizes the transformation-induced plasticity of retained austenite.

For example, regarding the high-strength cold-rolled steel sheets and the high-strength galvanized steel sheets, Patent Literature 1 discloses a technique of obtaining a low-yield-ratio, high-tensile steel sheet with excellent ductility by adding a particular amount of P and specifying the residence time in the temperature range of the Ac1 transformation point to 950° C. and the cooling rate thereafter.

Patent Literature 2 discloses a multi-phase steel sheet in which the texture is adjusted within an appropriate range to achieve both workability and shape fixability.

PATENT LITERATURE

PTL 1: Japanese Unexamined Patent Application Publication No. 58-22332

PTL 2: Japanese Unexamined Patent Application Publication No. 2004-124123

SUMMARY OF THE INVENTION

However, when an attempt is made to obtain a tensile strength (TS) as high as 590 MPa or more from the high-strength steel sheet described in Patent Literature 1, the problem of insufficient chemical conversion treatability arises.

Moreover, for the high-strength steel sheet described in Patent Literature 2, the total elongation (El) is not indicated in Examples, and it is unlikely that good strength-ductility balance is achieved.

Moreover, none of the patent literatures consider the planar anisotropy of YP.

The present invention has been developed under the above-described circumstances, and an object thereof is to provide a steel sheet that has a TS of 590 MPa or more, excellent ductility (strength-ductility balance), a low yield ratio (YR), excellent YP planar anisotropy, and excellent coatability when subjected to coating, a coated steel sheet, and methods for producing the steel sheet and the coated steel sheet. Another object is to provide a method for producing a hot-rolled steel sheet, a method for producing a cold-rolled full hard steel sheet, and a method for producing a heat-treated steel sheet needed to obtain the aforementioned steel sheet and the coated steel sheet.

For the purposes of the present invention, excellent ductility, i.e., El, means that the product, TS×El, is 12,000 MPa-% or more. Moreover a low YR means that the value, YR=(YP/TS)×100, is 75% or less. Moreover, excellent YP planar anisotropy means that the value of the index of the planar anisotropy of YP, |ΔYP|, is 50 MPa or less. Here, |ΔYP| is determined by formula (1) below:

$$|\Delta YP| = (YPL - 2 \times YPD + YPC)/2 \quad (1)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min. Excellent coatability means that the incidence of coating defects per 100 coils is 0.8% or less.

The inventors of the present invention have conducted extensive studies to obtain a steel sheet that has a TS of 590 MPa or more, excellent strength-ductility balance, low YR, excellent YP planar anisotropy, and excellent coatability when subjected to coating, and to obtain a coated steel sheet by using this steel sheet, and have found the following.

It has been found that by promoting recrystallization of ferrite during temperature elevation during annealing (the heating and cooling process performed after cold rolling (if cold rolling is not performed, after hot rolling)), the ductility can be improved, the YR can be decreased, and the YP planar anisotropy can be decreased all at the same time. Moreover, it has been confirmed that the coatability is also excellent, and the tensile strength is within the desired range.

As a result, it has become possible to obtain a steel sheet that has a TS of 590 MPa or more, excellent ductility, a low yield ratio (YR), excellent YP planar anisotropy, and excellent coatability when subjected to coating, and a coated steel sheet prepared by using the steel sheet.

The present invention has been made on the basis of the above-described findings.

[1] A steel sheet having: a composition that contains, in terms of mass %, C: 0.030% or more and 0.200% or less, Si: 0.70% or less, Mn: 1.50% or more and 3.00% or less, P: 0.001% or more and 0.100% or less, S: 0.0001% or more and 0.0200% or less, Al: 0.001% or more and 1.000% or less, N: 0.0005% or more and 0.0100% or less, and the balance being Fe and unavoidable impurities; a steel structure containing, in terms of area fraction, 20% or more of ferrite and 5% or more of martensite, wherein the ferrite has an average crystal grain size of 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less having; and, a tensile strength of 590 MPa or more.

[2] The steel sheet described in [1], wherein the composition further contains, in terms of mass %, at least one element selected from Cr: 0.01% or more and 1.00% or less, Nb: 0.001% or more and 0.100% or less, V: 0.001% or more and 0.100% or less, Ti: 0.001% or more and 0.100% or less, B: 0.0001% or more and 0.0100% or less, Mo: 0.01% or more and 0.50% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

[3] A coated steel sheet including the steel sheet described in [1] or [2], having a coating layer on a surface of the steel sheet.

[4] A method for producing a hot-rolled steel sheet, the method including heating a steel slab having the composition described in [1] or [2]; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; and coiling the cooled steel sheet under a condition of a coiling temperature of 300° C. or higher and 700° C. or lower.

[5] A method for producing a cold-rolled full hard steel sheet, the method including pickling a hot-rolled steel sheet obtained in the method described in [4] and cold-rolling the pickled steel sheet at a rolling reduction of 35% or more.

[6] A method for producing a steel sheet, the method including heating a hot-rolled steel sheet obtained in the method described in [4] or a cold-rolled full hard steel sheet obtained in the method described in [5] under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower.

[7] A method for producing a heat-treated steel sheet, the method including heating a hot-rolled steel sheet obtained in the method described in [4] or a cold-rolled full hard steel sheet obtained in the method described in [5] under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling.

[8] A method for producing a steel sheet, the method including re-heating a heat-treated steel sheet obtained in the method described in [7] to a temperature equal to or higher than the T1 temperature; and the cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower.

[9] A method for producing a coated steel sheet, the method including coating the steel sheet obtained by the method described in [6] or [8].

A steel sheet and a coated steel sheet obtained by the present invention have a TS of 590 MPa or more, excellent ductility, a low yield ratio (YR), excellent YP planar anisotropy, and excellent coatability. Moreover, when the steel sheet and the coated steel sheet obtained in the present invention are applied to, for example, automobile structural elements, fuel efficiency can be improved through car body weight reduction, and thus the present invention offers considerable industrial advantages.

Furthermore, the method for producing a hot-rolled steel sheet, the method for producing a cold-rolled full hard steel sheet, and the method for producing a heat-treated steel sheet according to the present invention serve as the methods for producing intermediate products for obtaining the steel sheet and the coated steel sheet with excellent properties described above and contribute to improving the properties of the steel sheet and the coated steel sheet described above.

DETAILED DESCRIPTION OF EMBODIMENTS OF THE INVENTION

The embodiments of the present invention will now be described. It should be understood that the present invention is not limited to the following embodiment.

The present invention provides a steel sheet, a coated steel sheet, a method for producing a hot-rolled steel sheet, a method for producing a cold-rolled full hard steel sheet, a method for producing a heat-treated steel sheet, a method for producing a steel sheet, and a method for producing a coated steel sheet. First, how these relate to one another is described.

A steel sheet of the present invention also serves as an intermediate product for obtaining a coated steel sheet of the present invention. In a one-stage method, a steel such as a slab is used as a starting material, and a coated steel sheet is obtained through the process of producing a hot-rolled steel sheet, a cold-rolled full hard steel sheet, and a steel sheet (however, when cold-rolling is not performed, the process of producing the cold-rolled full hard steel sheet is skipped). In a two-stage method, a steel such as a slab is used as a starting material, and a coated steel sheet is obtained through the process of producing a hot-rolled steel sheet, a cold-rolled full hard steel sheet, a heat-treated steel sheet, and a steel sheet (however, when cold-rolling is not performed, the process of producing the cold-rolled full hard steel sheet is skipped). The steel sheet of the present invention is the steel sheet used in the above-described process. The steel sheet may be a final product in some cases.

The method for producing a hot-rolled steel sheet of the present invention is the method that covers up to obtaining a hot-rolled steel sheet in the process described above.

The method for producing a cold-rolled full hard steel sheet of the present invention is the method that covers up to obtaining a cold-rolled full hard steel sheet from a hot-rolled steel sheet in the process described above.

The method for producing a heat-treated steel sheet of the present invention is the method that covers up to obtaining a heat-treated steel sheet from a hot-rolled steel sheet or a cold-rolled full hard steel sheet in the process described above in the two-stage method.

The method for producing a steel sheet of the present invention is the method that covers up to obtaining a steel sheet from a hot-rolled steel sheet or a cold-rolled full hard steel sheet in the process described above in the one-stage method, or is the method that covers up to obtaining a steel sheet from a heat-treated steel sheet in the two-stage method.

The method for producing a coated steel sheet of the present invention is the method that covers up to obtaining a coated steel sheet from a steel sheet in the process described above.

Since such a relationship exists, the compositions of the hot-rolled steel sheet, the cold-rolled full hard steel sheet, the heat-treated steel sheet, the steel sheet, and the coated steel sheet are common, and the steel structures of the steel sheet and the coated steel sheet are common. In the description below, the common features, the steel sheet, the coated steel sheet, and the production methods therefor are described in that order.

<Composition>

A steel sheet or the like of the present invention has a composition containing, in terms of mass %, C: 0.030% or more and 0.200% or less, Si: 0.70% or less, Mn: 1.50% or more and 3.00% or less, P: 0.001% or more and 0.100% or less, S: 0.0001% or more and 0.0200% or less, Al: 0.001% or more and 1.000% or less, N: 0.0005% or more and 0.0100%, and the balance being Fe and unavoidable impurities.

The composition may further contain, in terms of mass %, at least one element selected from Cr: 0.01% or more and 1.00% or less, Nb: 0.001% or more and 0.100% or less, V: 0.001% or more and 0.100% or less, Ti: 0.001% or more and 0.100% or less, B: 0.0001% or more and 0.0100% or less, Mo: 0.01% or more and 0.50% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

The individual components will now be described. In the description below, "%" that indicates the content of the component means "mass %".

C: 0.030% or More and 0.200% or Less

Carbon (C) is one of the important basic components of steel and is particularly important for the present invention since carbon affects the austenite area fraction when heated to a dual-phase region and also affects the martensite area fraction after transformation. The mechanical properties, such as strength, of the obtained steel sheet depend significantly on the martensite fraction (area fraction) and the hardness of martensite. Here, if the C content is less than 0.030%, formation of the martensite phase is inhibited, and it is difficult to obtain strength and workability of the steel sheet. Meanwhile, a C content exceeding 0.200% degrades spot weldability. Thus, the C content is set within a range of 0.030% or more and 0.200% or less. The lower limit of the C content is preferably 0.030% or more and more preferably 0.040% or more. The upper limit of the C content is preferably 0.150% or less and more preferably 0.120% or less.

Si: 0.70% or Less

Silicon (Si) is an element that improves workability, such as elongation, by decreasing the dissolved C content in the $\alpha$ phase. However, at a Si content exceeding 0.70%, degradation of surface quality due to occurrence of red scale etc., and, if hot-dip coating is to be performed, degradation of a coating adhering property and adhesion will result. Thus, the Si content is set to be 0.70% or less, preferably 0.60% or less, and more preferably 0.50% or less. The Si content is further preferably 0.40% or less, as described below. In the present invention, the Si content is usually 0.01% or more.

Silicon (Si) is an element that improves workability, such as elongation, by decreasing the dissolved C content in the $\alpha$ phase. However, at a Si content exceeding 0.40%, an effect of accelerating ferrite transformation during cooling during annealing and an effect of suppressing carbide generation are exhibited, the hardness of martensite increases, and the martensite-to-ferrite hardness ratio increases, thereby creating a tendency of degraded local elongation and degraded total elongation. Moreover, when galvanizing is to be performed, as long as the Si content is 0.40% or less, the increase in the amount of Si concentrated in the surface during annealing is sufficiently suppressed, and the wettability of the annealed sheet surface is further improved; thus, the issue of degradation of the coating-adhering property and adhesion occurs is less likely to arise. Thus, the Si content is more preferably set to 0.40% or less, and yet more preferably set to 0.35% or less. The Si content is yet more preferably less than 0.30%, and most preferably 0.25% or less.

Mn: 1.50% or More and 3.00% or Less

Manganese (Mn) is effective for securing the strength of the steel sheet. Manganese also improves hardenability and facilitates formation of a multi-phase structure. At the same time, Mn has an effect of suppressing generation of pearlite and bainite during the cooling process, and has a tendency to facilitate austenite-to-martensite transformation. In order to obtain these effects, the Mn content needs to be 1.50% or more. Meanwhile, a Mn content exceeding 3.00% degrades spot weldability and coatability. Moreover, castability or the like is degraded. At a Mn content exceeding 3.00%, the Mn segregation in the sheet thickness direction becomes prominent, the YR increases, and the value, TS×El, decreases. Thus, the Mn content is set to be 1.50% or more and 3.00% or less. The lower limit of the Mn content is preferably 1.60% or more. The upper limit of the Mn content is preferably 2.70% or less and more preferably 2.40% or less.

P: 0.001% or More and 0.100% or Less

Phosphorus (P) is an element that has an effect of solid solution strengthening and can be added according to the desired strength. Moreover, P is also an element that accelerates ferrite transformation and is effective for formation of a multi-phase structure. In order to obtain these effects, the P content needs to be 0.001% or more. Meanwhile, at a P content exceeding 0.100%, weldability is degraded, and, when galvannealing is to be performed, the speed of alloying is significantly decreased and the quality of the coating is impaired. At a P content exceeding 0.100%, grain boundary segregation causes embrittlement, and thus the impact resistance is degraded. Thus, the P content is set to be 0.001% or more and 0.100% or less. The lower limit of the P content is preferably 0.005% or more. The upper limit of the P content is preferably 0.050% or less.

S: 0.0001% or More and 0.0200% or Less

Sulfur (S) segregates in grain boundaries, embrittles the steel during hot-working, and forms sulfides that degrade local deformability. Thus, the S content needs to be 0.0200% or less. Meanwhile, from the limitation posed by the manufacturing technology, the S content needs to be 0.0001% or more. Thus, the S content is set to be 0.0001% or more and 0.0200% or less. The lower limit of the S content is preferably 0.0005% or more. The upper limit of the S content is preferably 0.0050% or less.

Al: 0.001% or More and 1.000% or Less

Aluminum (Al) is an element that suppresses generation of carbides and is effective for accelerating generation of retained austenite. Moreover, Al is an element that is added as deoxidizer in the steel-making process. In order to obtain these effects, the Al content needs to be 0.001% or more. Meanwhile, an Al content exceeding 1.000% increases the amount of inclusions in the steel sheet and degrades ductility. Thus, the Al content is set to be 0.001% or more and 1.000% or less. The lower limit of the Al content is preferably 0.030% or more. The upper limit of the Al content is preferably 0.500% or less.

N: 0.0005% or More and 0.0100% or Less

Nitrogen (N) is an element that degrades aging resistance of steel most. In particular at a N content exceeding 0.0100%, degradation of the aging resistance becomes prominent, and thus the N content is preferably as small as possible. However, from the limitation posed by the manufacturing technology, the N content needs to be 0.0005% or more. Thus, the N content is set to be 0.0005% or more and 0.0100% or less. The N content is preferably 0.0005% or more and 0.0070% or less.

The steel sheet or the like of the present invention may further contain, in addition to the composition described above, in terms of mass %, at least one element selected from Cr: 0.01% or more and 1.00% or less, Nb: 0.001% or more and 0.100% or less, V: 0.001% or more and 0.100% or less, Ti: 0.001% or more and 0.100% or less, B: 0.0001% or more and 0.0100% or less, Mo: 0.01% or more and 0.50% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

Chromium (Cr) not only has a role of a solid solution strengthening element but also stabilizes austenite during cooling during annealing and facilitates formation of the multi-phase structure. In order to obtain these effects, the Cr content is set to be 0.01% or more. However, at a Cr content exceeding 1.00%, enhancement of the effect is rarely achieved, and the surface layer may crack during hot-rolling; furthermore, the amount of inclusions and the like increases, the defects and the like are thereby induced in the surface or in the inside, and the ductility is significantly degraded. Thus, the Cr content is set within a range of 0.01% or more and 1.00% or less. The lower limit of the Cr content is preferably 0.02% or more. The upper limit of the Cr content is preferably 0.50% or less and more preferably 0.25% or less.

Niobium (Nb) forms fine precipitates during hot-rolling or annealing, and increases the strength. Niobium also reduces the size of grains during hot-rolling, and accelerates recrystallization of ferrite, which contributes to decreasing the YP planar anisotropy, during cold-rolling or the subsequent annealing. Moreover, since Nb reduces the ferrite grain size after annealing, the martensite fraction is increased, and Nb contributes to increasing the strength. In order to obtain these effects, the Nb content needs to be 0.001% or more. Meanwhile, at a Nb content exceeding 0.100%, composite precipitates, such as Nb—(C, N), occur excessively, the size of ferrite grains is reduced, and the yield ratio YR increases notably. Thus, if Nb is to be added, the Nb content is set within a range of 0.001% or more and 0.100% or less. The lower limit of the Nb content is preferably 0.005% or more. The upper limit of the Nb content is preferably 0.060% or less and more preferably 0.040% or less.

Vanadium (V) can increase the strength of steel by forming carbides, nitrides, or carbonitrides. In order to obtain this effect, the V content is set to be 0.001% or more. Meanwhile, at a V content exceeding 0.100%, V precipitates and forms large quantities of carbides, nitrides, or carbonitrides in former austenite grain boundaries, a substructure of martensite, or ferrite serving as a base phase, and significantly degrades workability. Thus, if V is to be added, the V content is set within a range of 0.001% or more and 0.100% or less. The lower limit of the V content is preferably 0.010% or more and more preferably 0.020% or more. The upper limit of the V content is preferably 0.080% or less and more preferably 0.070% or less.

Titanium (Ti) is an element effective for fixing N, which induces aging degradation, by forming TiN. This effect is obtained by setting the Ti content to 0.001% or more. Meanwhile, at a Ti content exceeding 0.100%, TiC occurs excessively, and the yield ratio YR increases notably. Thus, if Ti is to be added, the Ti content is set within a range of 0.001% or more and 0.100% or less.

Boron (B) is an element effective for strengthening the steel, and the effect of adding B is obtained at a B content of 0.0001% or more. Meanwhile, at a B content exceeding 0.0100%, the martensite area fraction becomes excessively large, and there occurs a risk of degradation of ductility due to the excessive increase in strength. Thus, the B content is set to be 0.0001% or more and 0.0100% or less. The lower limit of the B content is preferably 0.0005% or more, and the upper limit of the B content is preferably 0.0050% or less.

Molybdenum (Mo) is effective for obtaining a martensite phase without degrading chemical conversion treatability and coatability. This effect is obtained by setting the Mo content to 0.01% or more. However, at a Mo content exceeding 0.50%, enhancement of the effect is rarely achieved, the amount of inclusions and the like increases, the defects and the like are thereby formed in the surface or in the inside, and the ductility is significantly degraded. Thus, the Mo content is set within a range of 0.01% or more and 0.50% or less.

Copper (Cu) not only has a role of a solid solution strengthening element but also stabilizes austenite during the cooling process during annealing and facilitates formation of the multi-phase structure. In order to obtain these effects, the Cu content needs to be 0.01% or more. However, at a Cu content exceeding 1.00%, the surface layer may crack during hot-rolling, the amount of inclusions and the like increases, the defects and the like are thereby formed in the surface or in the inside, and the ductility is significantly degraded. Thus, if Cu is to be added, the Cu content is set within a range of 0.01% or more and 1.00% or less.

Nickel (Ni) contributes to increasing the strength by solid solution strengthening and transformation strengthening. In order to obtain this effect, the Ni content needs to be 0.01% or more. However, at a Ni content exceeding 1.00%, the surface layer may crack during hot-rolling, the amount of inclusions and the like increases, the defects and the like are thereby formed in the surface or in the inside, and the ductility is significantly degraded. Thus, if Ni is to be added, the Ni content is set within a range of 0.01% or more and 1.00% or less. More preferably, the Ni content is 0.50% or less.

Arsenic (As) is an element effective for improving corrosion resistance. In order to obtain this effect, the As content needs to be 0.001% or more. However, if As is added excessively, red shortness is accelerated, the amount of inclusions and the like increases, the defects and the like are thereby formed in the surface or in the inside, and the ductility is significantly degraded. Thus, if As is to be added, the As content is set within a range of 0.001% or more and 0.500% or less.

Antimony (Sb) and tin (Sn) are added as needed from the viewpoint of suppressing decarburization that occurs due to nitriding or oxidizing of the steel sheet surface in a region that spans about several ten micrometers from the steel sheet surface in the sheet thickness direction. This is because, when nitriding or oxidizing is suppressed, the decrease in the amount of martensite generated in the steel sheet surface is prevented, and the strength and the material stability of the steel sheet can be effectively ensured. In order to obtain these effects, the content needs to be 0.001% or more for both Sb and Sn. Meanwhile, if any of these elements is added in an amount exceeding 0.200%, toughness is degraded. Thus, if Sb and Sn are to be added, the content is set within a range of 0.001% or more and 0.200% or less for each of the elements.

Tantalum (Ta) contributes to increasing the strength by forming alloy carbides and alloy carbonitrides as with Ti and Nb. In addition, Ta is considered to have an effect of partly dissolving in Nb carbides and/or Nb carbonitrides to form composite precipitates such as (Nb, Ta) (C, N) so as to significantly suppress coarsening of precipitates and stabilize the contribution to improving the strength of the steel sheet by precipitation strengthening. Thus, Ta is preferably contained. Here, the effect of stabilizing the precipitates described above is obtained by setting the Ta content to 0.001% or more; however, when Ta is excessively added, the precipitate stabilizing effect is saturated, the amount of inclusions and the like increases, the defects and the like are thereby formed in the surface or in the inside, and the ductility is significantly degraded. Thus, if Ta is to be added, the Ta content is set within a range of 0.001% or more and 0.100% or less.

Calcium (Ca) and magnesium (Mg) are elements used for deoxidization, and also are elements that are effective for making sulfides spherical and alleviating adverse effects of sulfides on ductility, in particular, local ductility. In order to obtain these effects, at least one of these elements needs to be contained in an amount of 0.0001% or more. However, if the amount of at least one element selected from Ca and Mg exceeds 0.0200%, the amount of inclusions and the like increases, the defects and the like are thereby formed in the surface or in the inside, and the ductility is significantly degraded. Thus, if Ca and Mg are to be added, the content is set within a range of 0.0001% or more and 0.0200% or less for each of the elements.

Zinc (Zn), cobalt (Co), and zirconium (Zr) are elements effective for making sulfides spherical and alleviating adverse effects of sulfides on local ductility and stretch flangeability. In order to obtain this effect, at least one of these elements needs to be contained in an amount of 0.001% or more. However, if the amount of at least one element selected from Zn, Co, and Zr exceeds 0.020%, the amount of inclusions and the like increases, the defects and the like are thereby formed in the surface or in the inside, and the ductility is thereby degraded. Thus, if Zn, Co, and Zr are to be added, the content is set within a range of 0.001% or more and 0.020% or less for each of the elements.

A rare earth metal (REM) is an element effective for improving corrosion resistance. In order to obtain this effect, the REM content needs to be 0.0001% or more. However, if the REM content exceeds 0.0200%, the amount of inclusions and the like increases, the defects and the like are thereby formed in the surface or in the inside, and the ductility is thereby degraded. Thus, if REM is to be added, the REM content is set within a range of 0.0001% or more and 0.0200% or less.

The balance other than the above-described components is Fe and unavoidable impurities. For optional components described above, if their contents are less than the lower limits, the effects of the present invention are not impaired; thus, when these optional elements are contained in amounts less than the lower limits, these optional elements are deemed to be contained as unavoidable impurities.

<Steel Structure>

The steel structure of the steel sheet or the like of the present invention contains, in terms of area fraction, 20% or more of ferrite, and 5% or more of martensite, in which the ferrite has an average crystal grain size of 20 μm or less, the martensite has an average size of 15 μm or less, the ratio of the average crystal grain size of the ferrite to the average size of the martensite (ferrite average crystal grain size/martensite average size) is 0.5 to 10.0, the ratio of the hardness of the martensite to the hardness of the ferrite (martensite hardness/ferrite hardness) is 1.0 or more and 5.0 or less, and, in the texture of the ferrite, the inverse intensity ratio of γ-fiber to the α-fiber is 0.8 or more and 7.0 or less.

Area Fraction of Ferrite: 20% or More

This is an important invention-constituting element in the present invention. The steel structure of the steel sheet or the like of the present invention is a multi-phase structure in which martensite, which can mainly impart strength, is present in ferrite, which has high ductility and is soft. In order to obtain sufficient ductility and strike a balance between strength and ductility, the ferrite area fraction needs to be 20% or more. More preferably, the ferrite area fraction is 45% or more. The upper limit of the ferrite area fraction is not particularly limited; however, in order to obtain the martensite area fraction, i.e., to obtain strength, the upper limit is preferably 95% or less and more preferably 90% or less.

Area Fraction of Martensite: 5% or More

The desired TS cannot be obtained if the area fraction of the martensite (this means as-quenched martensite) if the area fraction of martensite is less than 5%. Thus, the martensite area fraction is set to be 5% or more. The lower limit of the martensite area fraction is not particularly limited; however, at a martensite area fraction exceeding 50%, local ductility is degraded and thus the total elongation (El) is degraded. Thus, the area fraction of martensite is set to be 5% or more, and is more preferably set to 5% or more and 50% or less. The lower limit of the area fraction of martensite is more preferably 7% or more. The upper limit of the area fraction of martensite is more preferably 40% or less.

The area fractions of ferrite and martensite can be obtained as follows. After a sheet-thickness section (L section) parallel to the rolling direction of the steel sheet is polished, the section is corroded with a 1 vol. % nital, and three view areas at a position at ¼ of the sheet thickness (the position at a depth of ¼ of the sheet thickness from the steel sheet surface) are observed by using a scanning electron microscope (SEM) at a magnification of ×1000. From the obtained structure images, the area fractions of the structural phases (ferrite and martensite) are calculated for three view areas by using Adobe Photoshop available from Adobe Systems, and the averages of the calculated results are assumed as the area fractions. Moreover, in the structure images described above, ferrite appears as a gray structure (matrix) and martensite appears as a white structure.

In the steel structure described above, the total area fraction of ferrite and martensite is preferably 85% or more. The effects of the present invention are not impaired even when the steel structure contains, in addition to ferrite and martensite, 20% or less of phases known to be included in steel sheets, such as un-recrystallized ferrite, tempered martensite, bainite, tempered bainite, pearlite, cementite, and retained austenite, in terms of area fraction.

Average Crystal Grain Size of Ferrite: 20 μm or Less

When the average crystal grain size of ferrite exceeds 20 μm, generation of martensite, which is favorable for increasing strength, is notably suppressed, and the desired TS cannot be obtained. The average crystal grain size of ferrite is preferably 18 μm or less. The lower limit of the average crystal grain size of ferrite is not particularly limited but is preferably 2 μm or more. Thus, the average crystal grain size of ferrite is 20 μm or less and is preferably 2 μm or more and 18 μm or less.

The average crystal grain size of ferrite is calculated as follows. That is, as in the observation of the phases described above, the observation position is set to the position at ¼ of the sheet thickness, the obtained steel sheet is observed with a SEM at a magnification of about ×1000, and the total area of the ferrite grains within the observation view area is divided by the number of ferrite grains so as to calculate the average area of the ferrite grains by using Adobe Photoshop mentioned above. The calculated average area is raised to the power of ½, and the result is assumed to be the average crystal grain size of ferrite.

Average Size of Martensite: 15 μm or Less

When the average size of martensite exceeds 15 μm, local ductility is degraded and thus the total elongation (El) is degraded. Thus, the average size of martensite is to be 15 μm or less. The lower limit of the average size of martensite is not particularly limited but is preferably 1 μm or more. Thus, the average size of martensite is to be 15 μm or less. The lower limit is more preferably 2 μm or more. The upper limit of the average size is preferably 12 μm or less.

The actual average size of martensite is calculated as follows. That is, as in the observation of the phases described above, the observation position is set to the position at ¼ of the sheet thickness, the obtained steel sheet is observed with a SEM at a magnification of about ×1000, and the total area of the martensite grains within the observation view area is divided by the number of martensite grains so as to calculate the average area of the martensite grains by using Adobe Photoshop mentioned above. The calculated average area is raised to the power of ½, and the result is assumed to be the average size of martensite.

Ratio of Average Crystal Grain Size of Ferrite to Average Size of Martensite (Ferrite Average Crystal Grain Size/Martensite Average Size): 0.5 to 10.0

When the ratio of the average crystal grain size of ferrite to the average size of martensite (ferrite average crystal grain size/martensite average size) is less than 0.5, the average size of martensite is large compared to the average crystal grain size of ferrite, and martensite grains affects the YP; thus, the TS and the YP are increased, and the desired YR is not obtained. Meanwhile, when the ratio of the average crystal grain size of ferrite and the average size of martensite exceeds 10.0, martensite becomes excessively small, and the desired strength is not obtained. Thus, the ratio of the average crystal grain size of ferrite to the average size of martensite is to be 0.5 to 10.0. The lower limit of the ratio is preferably 1.0 or more. The upper limit of the ratio is preferably 8.0 or less and more preferably 6.0 or less.

Hardness Ratio of Martensite to Ferrite (Hardness of Martensite/Hardness of Ferrite): 1.0 or More and 5.0 or Less The hardness ratio of martensite to ferrite is a critical invention-constituting element in controlling the YR and the ductility. When the hardness ratio of martensite to ferrite is less than 1.0, the yield ratio YR increases. Meanwhile, when the hardness ratio of martensite to ferrite exceeds 5.0, the local ductility is degraded and thus the total elongation (El) is degraded. Therefore, the hardness ratio of martensite to ferrite is to be 1.0 or more and 5.0 or less and is preferably 1.0 or more and 4.8 or less.

The hardness ratio of martensite to ferrite is obtained as follows. After a sheet-thickness section (L section) parallel to the rolling direction of the steel sheet is polished, the section is corroded with a 1 vol. % nital, and, at a position at ¼ of the sheet thickness (the position at a depth of ¼ of the sheet thickness from the steel sheet surface), the hardness of the ferrite phase and the hardness the martensite phase are each measured at five points with a micro hardness tester (DUH-W201S produced by Shimadzu Corporation) under the condition of a load of 0.5 gf so as to obtain the average hardness of each phase. The hardness ratio is calculated from the average hardness.

Inverse Intensity Ratio of γ-Fiber to α-Fiber in the Ferrite Texture: 0.8 or More and 7.0 or Less α-Fiber is a fibrous texture whose <110> axis is parallel to the rolling direction, and γ-fiber is a fibrous texture whose <111> axis is parallel to the normal direction of the rolled surface. A body-centered cubic metal is characterized in that α-fiber and γ-fiber strongly develop due to rolling deformation, and the textures that belong to them are formed even if annealing is conducted.

In the present invention, when the inverse intensity ratio of γ-fiber to the α-fiber in the ferrite texture exceeds 7.0, the texture orients in a particular direction of the steel sheet, and the planar anisotropy of mechanical properties, in particular, the planar anisotropy of the YP, is increased. Meanwhile, even when the inverse intensity ratio of γ-fiber to the α-fiber in the ferrite texture is less than 0.8, the planar anisotropy of mechanical properties, in particular, the planar anisotropy of the YP, is also increased. Thus, the inverse intensity ratio of γ-fiber to the α-fiber in the ferrite texture is to be 0.8 or more and 7.0 or less, and the lower limit of the intensity ratio is preferably 0.8 or more. The upper limit of the intensity ratio is preferably 6.5 or less.

In the present invention, the inverse intensity ratio of γ-fiber to the α-fiber in the ferrite texture can be obtained as follows. After a sheet-thickness section (L section) parallel to the rolling direction of the steel sheet is wet-polished and buff-polished with a colloidal silica solution so as to make the surface smooth and flat, the section is corroded with a 0.1 vol. % nital so as to minimize irregularities on the sample surface and completely remove the work-deformed layer. Next, at a position at ¼ of the sheet thickness (the position at a depth of ¼ of the sheet thickness from the steel sheet surface), crystal orientation is measured by SEM-EBSD (electron back-scatter diffraction), and, from the obtained data, the secondary phase containing martensite is eliminated by using the confidence index (CI) and image quality (IQ) by using OIM analysis available from AMETEK EDAX Company so as to extract only the ferrite texture. As a result, the inverse intensity ratio of the γ-fiber to the α-fiber of ferrite is calculated.

<Steel Sheet>

The composition and the steel structure of the steel sheet are as described above. The thickness of the steel sheet is not particularly limited but is typically 0.3 mm or more and 2.8 mm or less.

<Coated Steel Sheet>

A coated steel sheet of the present invention is constituted by the steel sheet of the present invention and a coating layer on the steel sheet. The type of the coating layer is not particularly limited, and may be, for example, a hot-dip coating layer or an electrocoating layer. The coating layer may be an alloyed coating layer. The coating layer is preferably a zinc coating layer. The zinc coating layer may contain Al and Mg. A hot-dip zinc-aluminum-magnesium alloy coating (Zn—Al—Mg coating layer) is also preferable. In this case, the Al content is preferably 1 mass % or more and 22 mass % or less, the Mg content is preferably 0.1 mass % or more and 10 mass % or less, and the balance is preferably Zn. In the case of the Zn—Al—Mg coating layer, a total of 1 mass % or less of at least one element selected from Si, Ni, Ce, and La may be contained in addition to Zn, Al, and Mg. The coating metal is not particularly limited, and Al coating and the like may be used in addition to the Zn coating described above. The coating metal is not particularly limited, and Al coating and the like may be used in addition to the Zn coating described above.

The composition of the coating layer is also not particularly limited and may be any typical composition. For example, in the case of a galvanizing layer or a galvannealing layer, typically, the composition contains Fe: 20 mass % or less and Al: 0.001 mass % or more and 1.0 mass % or less, a total of 0 mass % or more and 3.5 mass % or less of one or more elements selected from Pb, Sb, Si, Sn, Mg, Mn, Ni, Cr, Co, Ca, Cu, Li, Ti, Be, Bi, and REM, and the balance being Zn and unavoidable impurities. In the present invention, a galvanizing layer having a coating weight of 20 to 80 $g/m^2$ per side, or a galvannealing layer obtained by alloying this galvanizing layer is preferably provided. When the coating layer is a galvanizing layer, the Fe content in the coating layer is less than 7 mass %, and when the coating layer is a galvannealing layer, the Fe content in the coating layer is 7 to 20 mass %.

<Method for Producing Hot-Rolled Steel Sheet>

A method for producing a hot-rolled steel sheet according to the present invention includes heating a steel slab having the composition described above; rough-rolling the heated steel slab; in a subsequent finish-rolling, hot-rolling the rough-rolled steel slab under conditions a rolling reduction in the final pass of the finish rolling of 5% or more and 15% or less, a rolling reduction in the pass before the final pass of 15% or more and 25% or less, a finish-rolling inlet temperature of 1020° C. or higher and 1180° C. or lower, and a finish-rolling delivery temperature of 800° C. or higher and 1000° C. or lower; after the hot-rolling, cooling the resulting hot-rolled steel sheet under a condition of an average cooling rate of 5° C./s or more and 90° C./s or less; and coiling the cooled steel sheet under a condition of a coiling temperature of 300° C. or higher and 700° C. or lower. In the description below, the temperature is a steel sheet surface temperature unless otherwise noted. The steel sheet surface temperature can be measured with a radiation thermometer or the like.

In the present invention, the method for melting the steel (steel slab) is not particularly limited, and any know melting method such as one using a converter or an electric furnace is suitable. The casting method is also not particularly limited, but a continuous casting method is preferable. The steel slab (slab) is preferably produced by a continuous casting method to prevent macrosegregation, but can be produced by an ingot-making method, a thin-slab casting method, or the like. In addition to a conventional method that involves cooling the produced steel slab to room temperature and then re-heating the cooled steel slab, an energy-saving process, such as hot direct rolling, that involves directly charging a hot steel slab into a heating furnace without performing cooling to room temperature or rolling the steel slab immediately after very short recuperation can be employed without any issues. Moreover, the slab is formed into a sheet bar by rough-rolling under standard conditions; however, if the heating temperature is set relatively low, the sheet bar is preferably heated with a bar heater or the like before finish rolling in order to prevent troubles that occur during hot-rolling. In hot-rolling the slab, the slab may be re-heated in a heating furnace and then hot-rolled, or may be heated in a heating furnace at 1250° C. or higher for a short period of time and then hot-rolled.

The steel (slab) obtained as such is subjected to hot-rolling. In this hot-rolling, only rough rolling and finish rolling may be performed, or only finish rolling may be performed without rough rolling. In either case, the rolling reduction in the final pass of the finish rolling, the rolling reduction in the pass immediately before the final pass, the finish-rolling inlet temperature, and the finish-rolling delivery temperature are important.

Rolling Reduction in Final Pass of Finish Rolling: 5% or More and 15% or Less

Rolling Reduction in Pass Before Final Pass: 15% or More and 25% or Less

In the present invention, these features are important because when the rolling reduction in the pass before the final pass is set to be equal to or more than the rolling reduction in the final pass, the average crystal grain size of ferrite, the average size of martensite, and the texture can be appropriately controlled. When the rolling reduction in the final pass of the finish rolling is less than 5%, the ferrite crystal grains coarsen during hot-rolling, the crystal grains thereby coarsen in cold-rolling and subsequent annealing, and thus, the strength is degraded. Moreover, ferrite nucleation and growth occurs from very coarse austenite grains, and thus a so-called duplex-grained structure in which the generated ferrite grains vary in size is created. As a result, grains of a particular orientation grow during recrystallization annealing, resulting in an increase in YP planar anisotropy. Meanwhile, when the rolling reduction in the final pass exceeds 15%, the ferrite crystal grains become finer during hot-rolling, the ferrite crystal grains become finer in cold-rolling and subsequent annealing, and thus, the strength is increased. Moreover, the number of austenite nucleation sites increases at the time of annealing, fine martensite is generated, and, as a result, the YR is increased. Thus, the rolling reduction in the final pass of the finish rolling is set to be 5% or more and 15% or less.

When the rolling reduction in the pass before the final pass is less than 15%, a duplex-grained structure in which the generated ferrite grains generated during cooling after the final pass vary in size is created despite rolling of the very coarse austenite grains in the final pass, and, as a result, grains of a particular orientation grow during recrystallization annealing, resulting in an increase in YP planar anisotropy. Meanwhile, when the rolling reduction in the pass before the final pass exceeds 25%, the ferrite crystal grains become finer during hot-rolling, the crystal grains become finer in cold-rolling and subsequent annealing, and thus, the strength is increased. Moreover, the number of austenite nucleation sites increases at the time of annealing, fine martensite is generated, and, as a result, the YR is increased. Thus, the rolling reduction in the pass before the final pass of the finish annealing is set to be 15% or more and 25% or less.

Finish-Rolling Inlet Temperature: 1020° C. or Higher and 1180° C. or Lower

The steel slab after heating is hot-rolled through rough rolling and finish rolling so as to form a hot-rolled steel sheet. During this process, when the finish-rolling inlet temperature exceeds 1180° C., the amount of oxides (scale) generated increases rapidly, the interface between the base iron and oxides is roughened, the scale separability during descaling or pickling is degraded, and thus the surface quality after annealing is deteriorated. Moreover, if unseparated hot-rolled scale remains in some parts after pickling, ductility is adversely affected. Meanwhile, at a finish-rolling inlet temperature lower than 1020° C., the finish-rolling temperature after finish-rolling decreases, the rolling load during hot-rolling increases, and the rolling workload increases. Moreover, the rolling reduction while austenite is in an un-recrystallized state is increased, control of the texture after recrystallization annealing becomes difficult, and significant planar anisotropy is generated in the final product, thereby degrading the uniformity and stability of the materials. Furthermore, ductility itself is degraded. Thus, the finish-rolling inlet temperature of hot-rolling needs to be 1020° C. or higher and 1180° C. or lower. The finish-rolling inlet temperature is preferably 1020° C. or higher and 1160° C. or lower.

Finish-Rolling Delivery Temperature: 800° C. or Higher and 1000° C. or Lower

The steel slab after heating is hot-rolled through rough rolling and finish rolling so as to form a hot-rolled steel sheet. During this process, when the finish-rolling delivery temperature exceeds 1000° C., the amount of oxides (scale) generated increases rapidly, the interface between the base iron and oxides is roughened, and thus the surface quality after pickling and cold-rolling is deteriorated. Moreover, if unseparated hot-rolled scale remains in some parts after pickling, ductility is adversely affected. In addition, the crystal grains excessively coarsen, and the surface of a press product may become rough during working. Meanwhile, when the finish-rolling delivery temperature is lower than 800° C., the rolling load increases, the rolling workload increases, the rolling reduction while austenite is in an un-recrystallized state increases, an abnormal texture develops, and significant planar anisotropy is generated in the final product, thereby degrading the uniformity and stability of the materials. Furthermore, ductility itself is degraded. Workability is degraded when the finish-rolling delivery temperature is lower than 800° C. Thus, the finish-rolling delivery temperature hot-rolling needs to be 800° C. or higher and 1000° C. or lower. The lower limit of the finish-rolling delivery temperature is preferably 820° C. or higher. The upper limit of the finish-rolling delivery temperature is preferably 950° C. or lower.

As mentioned above, in this hot-rolling, only rough rolling and finish rolling may be performed, or only finish rolling may be performed without rough rolling.

Average cooling rate from after finish-rolling to coiling temperature: 5° C./s or more and 90° C./s or less By appropriately controlling the average cooling rate from after finish-rolling to the coiling temperature, the crystal grains of the phases in the hot-rolled steel sheet can be made finer, and, after the subsequent cold rolling and annealing, the r-fiber (check the difference from the description in 159 texture accumulation toward the {111}//ND orientation) can be enhanced. Here, if the average cooling rate from after finish-rolling to the coiling temperature exceeds 90° C./s, the shape of the sheet is significantly degraded, and problems may arise in the subsequent cold-rolling or annealing (heating and cooling process after hot-rolling (if cold-rolling is not performed) or cold-rolling) in the subsequent cold-rolling or annealing. Meanwhile, if the rate is less than 5° C./s, the crystal grain size in the hot-rolled sheet structure increases, and accumulation into γ-fiber cannot be enhanced in the texture after the subsequent cold-rolling and annealing. Moreover, coarse carbides are formed during hot-rolling, and remain even after annealing, which degrades workability. Thus, the average cooling rate from after the finish-rolling to the coiling temperature is set to be 5° C./s or more and 90° C./s or less, and the lower limit of the average cooling rate is preferably 7° C./s or more and more preferably 9° C./s or more. The upper limit of the average cooling rate is preferably 60° C./s or less and more preferably 50° C./s or less.

Coiling Temperature: 300° C. or Higher and 700° C. or Lower

When the coiling temperature after hot-rolling exceeds 700° C., the ferrite crystal grain size in the steel structure of the hot-rolled sheet (hot-rolled steel sheet) increases, and after annealing, it becomes difficult to obtain the desired strength and decrease the YP planar anisotropy attributable to the texture. Meanwhile, when the coiling temperature after the hot-rolling is lower than 300° C., the hot-rolled sheet strength increases, the rolling workload during cold-rolling increases, the productivity is degraded. Moreover, when a hard hot-rolled steel sheet mainly composed of martensite is cold-rolled, minute inner cracking (brittle cracking) is likely to occur along the former austenite grain boundaries of martensite, and the ductility and the like of the final product, annealed sheet (steel sheet) is degraded. Thus, the coiling temperature after hot-rolling needs to be 300° C. or higher and 700° C. or lower. The lower limit of the coiling temperature is preferably 400° C. or higher. The upper limit of the coiling temperature is preferably 650° C. or lower.

During hot-rolling, rough-rolled sheets may be joined with each other and finish-rolling may be conducted continuously. Moreover, the rough-rolled sheet may be temporarily coiled. Furthermore, in order to decrease the rolling load during hot-rolling, part or the entirety of the finish-rolling may be lubricated. Performing lubricated rolling is also effective from the viewpoints of uniformity of the steel sheet shape and uniformity of the material. The coefficient of friction during lubricated rolling is preferably in the range of 0.10 or more and 0.25 or less.

<Method for Producing Cold-Rolled Full Hard Steel Sheet>

A method for producing cold-rolled full hard steel sheet of the present invention involves pickling the hot-rolled steel sheet described above and cold-rolling the pickled steel sheet at a rolling reduction of 35% or more.

Pickling can remove oxides on the steel sheet surface, and thus is critical for ensuring excellent chemical conversion treatability and coating quality of the final products, such as steel sheets and coated steel sheets. Pickling may be performed once, or in fractions several times.

Rolling Reduction in Cold-Rolling Step (Rolling Reduction): 35% or More

Cold-rolling after hot-rolling causes the α-fiber and the γ-fiber to develop and thereby increases the amount of ferrite having the α-fiber and the γ-fiber, in particular, ferrite having the γ-fiber, in a structure after annealing, and, thus, the YP planar anisotropy can be decreased. In order to achieve such effects, the lower limit of the rolling reduction for cold-rolling is set to be 35%. Note that the number of times the rolling pass is performed, and the rolling reduction of each pass are not particularly limited in obtaining the effects of the present invention. The upper limit of the rolling reduction is not particularly limited, but, from the industrial viewpoint, is about 80%.

<Method for Producing Steel Sheet>

The method for producing steel sheet is a method (one-stage method) with which a hot-rolled steel sheet or a cold-rolled full hard steel sheet is heated and cooled to produce a steel sheet, or a method (two-stage method) with which a hot-rolled steel sheet or a cold-rolled full hard steel sheet is heated and cooled to form a heat-treated steel sheet, and the heat-treated steel sheet is heated and cooled to form a steel sheet. First, the one-stage method is described.

Maximum Attained Temperature: T1 Temperature or Higher and T2 Temperature or Lower When the maximum attained temperature is lower than the T1 temperature, the heat treatment is performed in the ferrite single phase region, and thus, the secondary phase containing martensite is not generated after annealing, the desired strength cannot be obtained, and the YR is increased. Meanwhile, when the maximum attained temperature exceeds the T2 temperature during annealing, the secondary phase containing martensite generated after annealing is increased, the strength is increased, and the ductility is degraded. Thus, the maximum attained temperature in annealing is set to be the T1 temperature or higher and T2 temperature or lower.

The holding time for holding the maximum attained temperature is not particularly limited but is preferably 10 s or longer and 40,000 s or shorter.

Average Heating Rate in Temperature Range of 450° C. to [T1 Temperature—10° C.]: 50° C./s or Less During heating up to the maximum attained temperature described above, if the average heating rate in the temperature range of 450° C. to [T1 temperature—10° C.] exceeds 50° C./s, recrystallization of ferrite is insufficient, and the YP planar anisotropy is increased. Moreover, at an average heating rate exceeding 50° C./s, the average crystal grain size of ferrite becomes small, the average crystal grain size of martensite becomes large, and the fractions are increased; thus, the YP and the YR are increased. Thus, the average cooling rate is to be 50° C./s or less. The rate is preferably 40° C./s or less and more preferably 30° C./s or less. The lower limit of the average heating rate in the temperature range of 45° ° C. to [T1 temperature—10° C.] is not particularly limited; however, at an average heating rate less than 0.001° C./s, the ferrite crystal grain size in the annealed sheet (steel sheet) is increased, and generation of the secondary phase favorable for increasing the strength is significantly suppressed. Thus, the lower limit is preferably 0.001° C./s or more.

Average Cooling Rate in Temperature Range of [T1 Temperature—10° C.] to 550° C.: 3° C./s or More During cooling after the heating described above, when the average cooling rate in the temperature range of [T1 temperature—10° C.] to 550° C. is less than 3° C./s, ferrite and pearlite occur excessively during cooling, and the desired amount of martensite is not obtained. Thus, the average cooling rate in the temperature range of [T1 temperature—10° C.] to 550° C. is set to be 3° C./s or more. The upper limit of the average heating rate in the temperature range of 450° C. to [T1 temperature—10° C.] is not particularly limited, but is preferably 100° C./s or lower since at a rate exceeding 100° C./s, the sheet shape is degraded due to rapid heat shrinkage, and this may pose operational issues such as transverse displacement.

Dew Point in Temperature Range of 600° C. or Higher: −40° C. or Lower

During annealing, when the dew point in the temperature range of 600° C. or higher is high, decarburization proceeds through moisture in the air, the ferrite grains in the steel sheet surface layer portion coarsen, and the hardness is degraded; thus, excellent tensile strength is not stably obtained and the bending fatigue properties are degraded in some cases. Moreover, when coating is to be performed, the elements, such as Si and Mn, that obstruct coating concentrate in the steel sheet surface during annealing, and the coatability is obstructed. Thus, the dew point in the temperature range of 600° C. or higher during annealing needs to be −40° C. or lower. More preferably, the dew point is −45° C. or lower. In the typical annealing process that involves heating, soaking, and cooling steps, the dew point in the temperature range of 600° C. or higher needs to be −40° C. or lower in all the steps. The lower limit of the dew point in the atmosphere is not particularly limited, but when the lower limit is lower than −80° C., the effect is saturated and there is a cost disadvantage. Thus, the lower limit is preferably −80° C. or higher. The temperature in the temperature ranges described above is based on the steel sheet surface temperature. In other words, the dew point is adjusted to be within the above-described range when the steel sheet surface temperature is within the above-described temperature range.

The cooling stop temperature during cooling is not particularly limited but is typically 120 to 550° C.

Next, the process in which annealing is performed twice (two-stage method) is described. In the two-stage method, first, a hot-rolled steel sheet or a cold-rolled full hard steel sheet is heated to prepare a heat-treated steel sheet. The method for obtaining this heat-treated steel sheet is the method for producing a heat-treated steel sheet according to the present invention.

A specific method for obtaining the heat-treated steel sheet described above is a method that involves heating a hot-rolled steel sheet or a cold-rolled full hard steel sheet under a condition of an average heating rate of 50° C./s or less in a temperature range of 450° C. to [T1 temperature—10° C.] until a maximum attained temperature of T1 temperature or more and T2 temperature or less is reached, holding the heated steel sheet for a particular amount of time in the temperature range of the T1 temperature or more and the T2 temperature or less as needed, cooling the resulting sheet, and pickling the cooled sheet.

The technical significance of the average heating rate and the maximum attained temperature is the same as that of the one-stage method, and the description therefor is omitted. In order to obtain a heat-treated steel sheet, after the sheet is held as needed, cooling and pickling are performed.

The cooling rate during the cooling is not particularly limited but is typically 5 to 350° C./s.

Since the elements, such as Si and Mn, that obstruct coating concentrate in the surface during re-heating of the heat-treated steel sheet described below, and the coatability is deteriorated thereby, the high-concentration surface layer needs to be removed by pickling or the like. However, whether or not descaling by pickling is performed after coiling after hot-rolling does not affect the effects of the present invention in any way. In order to improve sheet passability, skinpass rolling may be performed on the heat-treated steel sheet before the pickling.

Re-Heating Temperature: T1 Temperature or Higher

In the two-stage method, recrystallization of ferrite is completed by the first heating and cooling process; thus, the re-heating temperature of the heat-treated steel sheet may be equal to or higher than the T1 temperature, at which austenite occurs. However, at a temperature lower than the T1 temperature, formation of austenite becomes insufficient, and it becomes difficult to obtain the desired amount of martensite. Thus, the re-heating temperature is set to be equal to higher than the T1 temperature. The upper limit is not particularly limited, but when the upper limit exceeds 850° C., the elements such as Si and Mn concentrate in the surface again and may degrade the coatability. Thus, the upper limit is preferably 850° C. or lower. More preferably, the upper limit is 840° C. or lower.

Average Cooling Rate in Temperature Range of [T1 Temperature—10° C.] to 550° C.: 3° C./s or More When the average cooling rate in the temperature range of [T1 temperature—10° C.] to 550° C. is less than 3° C./s, ferrite and pearlite occur excessively during cooling, the desired amount of martensite is not obtained, and the YR is increased. Thus, the average cooling rate in the temperature range of [T1 temperature—10° C.] to 550° C. is set to be 3° C./s or more. The upper limit of the average heating rate in the temperature range of 450° C. to [T1 temperature—10° C.] is not particularly limited, but is preferably 100° C./s or lower since at a rate exceeding 100° C./s, the sheet shape is degraded due to rapid heat shrinkage, and this may pose operational issues such as meandering.

Dew Point in Temperature Range of 600° C. or Higher: −40° C. or Lower

During annealing, when the dew point in the temperature range of 600° C. or higher is high, decarburization proceeds through moisture in the air, the ferrite grains in the steel sheet surface layer portion coarsen, and the hardness is degraded; thus, excellent tensile strength is not stably obtained and the bending fatigue properties are degraded in some cases. Moreover, when coating is to be performed, the elements, such as Si and Mn, that obstruct coating concentrate in the steel sheet surface during annealing, and the coatability is obstructed. Thus, the dew point in the temperature range of 600° C. or higher during annealing needs to be −40° C. or lower. More preferably, the dew point is −45° C. or lower. In the typical annealing process that involves heating, soaking, and cooling steps, the dew point in the temperature range of 600° C. or higher needs to be −40° C. or lower in all the steps. The lower limit of the dew point in the atmosphere is not particularly limited, but when the lower limit is lower than −80° C., the effect is saturated and there is a cost disadvantage. Thus, the lower limit is preferably −80° C. or higher. In the description below, the temperature is a steel sheet surface temperature unless otherwise noted. The steel sheet surface temperature can be measured with a radiation thermometer or the like.

The steel sheet obtained in the one-stage method or the two-stage method described above may be subjected to skinpass rolling. The skinpass rolling ratio is more preferably 0.1% or more and 1.5% or less since at less than 0.1%, the yield point elongation does not disappear, and at a ratio exceeding 1.5%, the yield stress of the steel increases and the YR is increased. More preferably, the lower limit is 0.5% or more.

When the steel sheet is the subject of the trade, the steel sheet is usually cooled to room temperature, and then traded.

<Method for Producing Coated Steel Sheet>

The method for producing a coated steel sheet of the present invention is the method that involves performing coating on the steel sheet. Examples of the coating process include a galvanizing process, and a galvannealing process. Annealing and galvanizing may be continuously performed using one line. Alternatively, the coating layer may be formed by electroplating, such as Zn—Ni alloy electroplating, or the steel sheet may be coated with hot-dip zinc-aluminum-magnesium alloy. Although galvanizing is mainly described herein, the type of coating metal is not limited and may be Zn coating or Al coating.

In performing the galvanizing process, the steel sheet is dipped in a zinc coating bath at 440° C. or higher and 500° C. or lower to galvanize the steel sheet, and the coating weight is adjusted by gas wiping or the like. In galvanizing, a zinc coating bath having an Al content of 0.10 mass % or more and 0.23 mass % or less is preferably used. In performing the galvannealing process, the zinc coating is subjected to an alloying process in a temperature range of 470° C. or higher and 600° C. or lower after galvanizing. When the alloying process is performed at a temperature exceeding 600° C., untransformed austenite transforms into pearlite, and the TS may be degraded. Thus, in performing the galvannealing process, the alloying process is preferably performed in a temperature range of 470° C. or higher and 600° C. or lower. Moreover, an electrogalvanizing process may be performed. The coating weight per side is preferably 20 to 80 g/m$^2$ (coating is performed on both sides), and the galvannealed steel sheet (GA) is preferably subjected to the following alloying process so as to adjust the Fe concentration in the coating layer to 7 to 15 mass %.

The rolling reduction in skinpass rolling after the coating process is preferably in the range of 0.1% or more and 2.0% or less. At a rolling reduction less than 0.1%, the effect is small and control is difficult; and thus, 0.1% is the lower limit of the preferable range. At a rolling reduction exceeding 2.0%, the productivity is significantly degraded, and thus 2.0% is the upper limit of the preferable range. Skinpass rolling may be performed on-line or off-line. Skinpass may be performed once at a targeted rolling reduction, or may be performed in fractions several times.

Other conditions of the production methods are not particularly limited; however, from the productivity viewpoint, a series of processes such as annealing, galvanizing, galvannealing, etc., are preferably performed in a continuous galvanizing line (CGL). After galvanizing, wiping can be performed to adjust the coating weight. The conditions of the coating etc., other than the conditions described above may the typical conditions for galvanization.

EXAMPLES

Steels each having a composition indicated in Table 1 with the balance being Fe and unavoidable impurities were melted in a converter, and prepared into slabs by a continuous casting method. The obtained slab was heated under the conditions indicated in Table 2 and hot-rolled, pickled, and, in Nos. 1 to 18, 20 to 25, 27, 28, and 30 to 35 in Table 2, cold-rolled.

Next, an annealing process was performed under the conditions indicated in Table 2 so as to obtain steel sheets (those samples having marks in the pre-annealing column are prepared by the two-stage method).

Some of the steel sheets were subjected to a coating process so as to obtain galvanized steel sheets (GI), galvannealed steel sheets (GA), electrogalvanized steel sheets (EG), and hot-dip zinc-aluminum-magnesium alloy coated steel sheets (ZAM). A zinc bath with Al: 0.14 to 0.19 mass % was used as the galvanizing bath for GI, and a zinc bath with Al: 0.14 mass % was used for GA. The bath temperature was 470° C. The coating weight was about 45 to 72 g/m$^2$ per side (both sides were coated) for GI and about 45 g/m$^2$ per side (both sides were coated) for GA. In GA, the Fe concentration in the coating layer was adjusted to 9 mass % or more and 12 mass % or less. In EG with a Zn—Ni coating layer as the coating layer, the Ni content in the coating layer was adjusted to 9 mass % or more and 25 mass % or less. In ZAM with a Zn—Al—Mg coating layer as the coating layer, the Al content in the coating layer was adjusted to 3 mass % or more and 22 mass % or less, and the Mg content was adjusted to 1 mass % or more and 10 mass % or less.

The T1 temperature (° C.) was obtained from the following formula:

$$T1 \text{ temperature } (^\circ \text{C.}) = 745 + 29 \times [\%\ \text{Si}] - 21 \times [\%\ \text{Mn}] + 17 \times [\%\ \text{Cr}]$$

The T2 temperature (° C.) was calculated as follows:

T2 temperature (° C.)=960−203×[% C]½+45×[% Si]−30×[% Mn]+150×[% Al]−20×[% Cu]+11×[% Cr]+350×[% Ti]+104×[% V] Note that [% X] denotes the mass % of the component element X of the steel sheet, and when that element is not contained, 0 is indicated.

TABLE 1

| Steel | Composition (mass %) | | | | | | | | | |
|---|---|---|---|---|---|---|---|---|---|---|
| type | C | Si | Mn | P | S | Al | N | Cr | Nb | V |
| A | 0.098 | 0.02 | 2.44 | 0.016 | 0.0034 | 0.087 | 0.0024 | 0.20 | — | — |
| B | 0.051 | 0.34 | 1.71 | 0.035 | 0.0031 | 0.036 | 0.0023 | 0.23 | 0.012 | 0.044 |
| C | 0.032 | 0.03 | 2.10 | 0.027 | 0.0049 | 0.073 | 0.0018 | 0.14 | — | — |
| D | 0.072 | 0.01 | 2.50 | 0.038 | 0.0035 | 0.079 | 0.0013 | 0.21 | — | — |
| E | 0.075 | 0.01 | 2.02 | 0.039 | 0.0041 | 0.100 | 0.0011 | 0.09 | 0.010 | 0.041 |
| F | 0.026 | 0.28 | 2.33 | 0.029 | 0.0050 | 0.032 | 0.0017 | 0.16 | — | — |
| G | 0.077 | 0.18 | 1.16 | 0.035 | 0.0047 | 0.082 | 0.0021 | 0.20 | 0.011 | 0.060 |
| H | 0.082 | 0.10 | 3.42 | 0.009 | 0.0042 | 0.056 | 0.0047 | 0.13 | 0.019 | 0.015 |
| I | 0.032 | 0.16 | 2.27 | 0.010 | 0.0024 | 0.082 | 0.0034 | 0.24 | — | — |
| J | 0.059 | 0.01 | 2.04 | 0.046 | 0.0012 | 0.085 | 0.0049 | 0.18 | 0.018 | 0.016 |
| K | 0.048 | 0.04 | 2.26 | 0.043 | 0.0041 | 0.060 | 0.0028 | 0.08 | 0.011 | 0.046 |
| L | 0.063 | 0.07 | 2.16 | 0.021 | 0.0013 | 0.093 | 0.0039 | — | — | — |
| M | 0.107 | 0.04 | 2.47 | 0.031 | 0.0036 | 0.040 | 0.0028 | 0.12 | 0.034 | 0.032 |
| N | 0.086 | 0.04 | 2.60 | 0.050 | 0.0042 | 0.079 | 0.0040 | 0.16 | — | — |
| O | 0.054 | 0.01 | 2.49 | 0.042 | 0.0017 | 0.062 | 0.0016 | 0.14 | 0.028 | 0.026 |
| P | 0.063 | 0.18 | 2.39 | 0.032 | 0.0025 | 0.077 | 0.0016 | — | — | — |
| Q | 0.111 | 0.04 | 1.86 | 0.014 | 0.0032 | 0.031 | 0.0016 | 0.22 | 0.013 | 0.039 |
| R | 0.053 | 0.06 | 2.06 | 0.013 | 0.0046 | 0.057 | 0.0025 | — | — | — |
| S | 0.098 | 0.04 | 1.86 | 0.007 | 0.0040 | 0.034 | 0.0026 | 0.20 | 0.023 | 0.018 |
| T | 0.070 | 0.02 | 2.41 | 0.013 | 0.0038 | 0.033 | 0.0013 | 0.10 | 0.017 | 0.037 |
| U | 0.097 | 0.23 | 2.02 | 0.031 | 0.0041 | 0.042 | 0.0029 | — | — | — |
| V | 0.092 | 0.04 | 2.44 | 0.042 | 0.0050 | 0.037 | 0.0010 | 0.07 | 0.008 | 0.030 |
| W | 0.076 | 0.04 | 2.32 | 0.032 | 0.0031 | 0.053 | 0.0020 | 0.15 | — | — |
| X | 0.063 | 0.04 | 2.04 | 0.039 | 0.0039 | 0.053 | 0.0015 | 0.21 | — | — |

| Steel | Composition (mass %) | | | | | | | | | |
|---|---|---|---|---|---|---|---|---|---|---|
| type | Ti | B | Mo | Cu | Ni | As | Sb | Sn | Ta | Ca |
| A | — | — | — | — | — | — | — | — | — | — |
| B | — | — | — | — | — | — | — | — | — | — |
| C | 0.028 | 0.0009 | — | — | — | — | — | — | — | — |
| D | — | — | — | — | — | — | — | — | — | — |
| E | 0.024 | 0.0014 | — | — | — | — | — | — | — | — |
| F | 0.028 | 0.0006 | — | — | — | — | — | — | — | — |
| G | — | — | — | — | — | — | — | — | — | — |
| H | 0.034 | 0.0014 | — | — | — | — | — | — | — | — |
| I | 0.033 | 0.0019 | — | — | — | — | — | — | — | — |
| J | — | — | — | — | — | — | — | — | — | — |
| K | 0.023 | 0.0017 | — | — | — | — | — | — | — | — |
| L | — | — | — | — | — | — | — | — | — | — |

TABLE 1-continued

| | | | | | | | | | | |
|---|---|---|---|---|---|---|---|---|---|---|
| M | 0.024 | 0.0014 | 0.18 | — | — | — | — | — | — | — |
| N | 0.017 | 0.0017 | — | 0.23 | — | — | — | — | — | — |
| O | 0.018 | 0.0017 | — | — | — | — | 0.0055 | — | — | — |
| P | — | — | — | — | 0.07 | 0.004 | — | 0.0058 | — | — |
| Q | — | — | — | — | — | — | — | — | 0.0049 | — |
| R | — | — | — | — | — | — | 0.0064 | — | — | — |
| S | — | — | — | — | — | — | — | 0.0034 | — | — |
| T | 0.030 | 0.0008 | — | — | — | — | — | — | 0.0059 | — |
| U | — | — | — | — | — | — | — | — | — | 0.0029 |
| V | 0.020 | 0.0009 | — | — | — | — | — | — | — | — |
| W | — | — | — | — | — | — | — | — | — | — |
| X | — | — | — | — | — | — | — | — | — | — |

| Steel | Composition (mass %) | | | | | T1 temperature | T2 temperature | |
|---|---|---|---|---|---|---|---|---|
| type | Mg | Zn | Co | Zr | REM | (° C.) | (° C.) | Remarks |
| A | — | — | — | — | — | 698 | 840 | Invention steel |
| B | — | — | — | — | — | 723 | 890 | Invention steel |
| C | — | — | — | — | — | 704 | 884 | Invention steel |
| D | — | — | — | — | — | 696 | 845 | Invention steel |
| E | — | — | — | — | — | 704 | 873 | Invention steel |
| F | — | — | — | — | — | 707 | 886 | Comparative steel |
| G | — | — | — | — | — | 729 | 898 | Comparative steel |
| H | — | — | — | — | — | 678 | 827 | Comparative steel |
| I | — | — | — | — | — | 706 | 889 | Invention steel |
| J | — | — | — | — | — | 706 | 866 | Invention steel |
| K | — | — | — | — | — | 700 | 872 | Invention steel |
| L | — | — | — | — | — | 702 | 861 | Invention steel |
| M | — | — | — | — | — | 696 | 840 | Invention steel |
| N | — | — | — | — | — | 694 | 839 | Invention steel |
| O | — | — | — | — | — | 696 | 859 | Invention steel |
| P | — | — | — | — | — | 700 | 857 | Invention steel |
| Q | — | — | — | — | — | 711 | 849 | Invention steel |
| R | — | — | — | — | — | 703 | 862 | Invention steel |
| S | — | — | — | — | — | 711 | 852 | Invention steel |
| T | — | — | — | — | — | 697 | 855 | Invention steel |
| U | — | — | — | 0.003 | — | 709 | 853 | Invention steel |
| V | 0.0035 | 0.0090 | 0.0187 | — | — | 696 | 843 | Invention steel |
| W | — | — | — | — | 0.0031 | 700 | 846 | Invention steel |
| X | — | — | — | — | — | 707 | 860 | Invention steel |

TABLE 2

| No. | Steel type | Finish-rolling inlet temperature (° C.) | Pass immediately before final pass (%) | Final pass (%) | Finish-rolling delivery temperature (° C.) | Average cooling rate from after finish rolling to coiling temperature (° C./s) | Coiling temperature (° C.) | Whether cold-rolling is performed (Yes/No) | Rolling reduction in cold-rolling (%) |
|---|---|---|---|---|---|---|---|---|---|
| 1 | A | 1060 | 20 | 10 | 880 | 13 | 530 | Yes | 45 |
| 2 | B | 1050 | 20 | 11 | 870 | 12 | 480 | Yes | 41 |
| 3 | C | 1040 | 19 | 11 | 890 | 15 | 530 | Yes | 44 |
| 4 | C | 980 | 22 | 9 | 881 | 24 | 540 | Yes | 48 |
| 5 | C | 1030 | 23 | 3 | 985 | 20 | 500 | Yes | 44 |
| 6 | C | 1060 | 20 | 10 | 770 | 26 | 480 | Yes | 47 |
| 7 | C | 1040 | 21 | 11 | 860 | 4 | 480 | Yes | 41 |
| 8 | C | 1070 | 19 | 12 | 905 | 18 | 510 | Yes | 31 |
| 9 | C | 1160 | 19 | 10 | 900 | 25 | 600 | Yes | 45 |
| 10 | C | 1050 | 23 | 11 | 930 | 26 | 530 | Yes | 46 |
| 11 | C | 1060 | 22 | 10 | 910 | 23 | 510 | Yes | 43 |
| 12 | C | 1060 | 20 | 12 | 880 | 19 | 510 | Yes | 44 |
| 13 | C | 1150 | 20 | 10 | 860 | 21 | 480 | Yes | 42 |
| 14 | C | 1160 | 19 | 9 | 880 | 34 | 480 | Yes | 44 |
| 15 | D | 1040 | 19 | 11 | 870 | 20 | 480 | Yes | 43 |
| 16 | E | 1060 | 22 | 11 | 850 | 10 | 530 | Yes | 44 |
| 17 | F | 1050 | 21 | 10 | 980 | 14 | 570 | Yes | 41 |
| 18 | G | 1060 | 22 | 10 | 900 | 42 | 490 | Yes | 40 |
| 19 | H | 1030 | 20 | 12 | 870 | 26 | 620 | No | 0 |
| 20 | I | 1160 | 22 | 12 | 880 | 21 | 540 | Yes | 44 |
| 21 | J | 1050 | 23 | 9 | 900 | 18 | 470 | Yes | 40 |
| 22 | K | 1060 | 19 | 11 | 870 | 21 | 500 | Yes | 42 |
| 23 | L | 1040 | 22 | 9 | 900 | 10 | 530 | Yes | 35 |

TABLE 2-continued

| | | | | | | | | | |
|---|---|---|---|---|---|---|---|---|---|
| 24 | M | 1160 | 22 | 11 | 870 | 26 | 480 | Yes | 47 |
| 25 | N | 1040 | 23 | 9 | 900 | 34 | 560 | Yes | 48 |
| 26 | O | 1060 | 20 | 11 | 860 | 10 | 480 | No | 0 |
| 27 | P | 1050 | 22 | 11 | 880 | 15 | 470 | Yes | 44 |
| 28 | Q | 1060 | 20 | 12 | 880 | 14 | 480 | Yes | 39 |
| 29 | R | 1030 | 20 | 10 | 860 | 18 | 470 | No | 0 |
| 30 | S | 1160 | 21 | 12 | 870 | 10 | 520 | Yes | 38 |
| 31 | T | 1050 | 20 | 12 | 900 | 15 | 420 | Yes | 37 |
| 32 | U | 1060 | 21 | 11 | 880 | 9 | 520 | Yes | 45 |
| 33 | V | 1040 | 21 | 12 | 850 | 15 | 480 | Yes | 36 |
| 34 | W | 1150 | 20 | 11 | 870 | 18 | 470 | Yes | 39 |
| 35 | X | 1150 | 20 | 11 | 870 | 18 | 470 | Yes | 44 |

| | Pre-annealing conditions | | Annealing conditions | | | | | | |
|---|---|---|---|---|---|---|---|---|---|
| No. | Average heating rate*1 (° C./s) | Maximum attained temperature (° C.) | Dew point in temperature range of 600° C. or higher (° C.) | Average heating rate*1 (° C./s) | Maximum attained temperature (° C.) | Average cooling rate*2 (° C./s) | Presence of coating (Yes/No) | Type of coating etc. (*) | Remarks |
| 1 | — | — | −45 | 10 | 810 | 25 | No | CR | Example |
| 2 | 10 | 820 | −45 | — | 770 | 12 | Yes | GA | Example |
| 3 | — | — | −46 | 10 | 830 | 16 | Yes | GA | Example |
| 4 | — | — | −43 | 20 | 840 | 15 | Yes | GA | Comparative Example |
| 5 | — | — | −43 | 20 | 820 | 18 | Yes | GA | Comparative Example |
| 6 | — | — | −47 | 5 | 820 | 20 | Yes | GI | Comparative Example |
| 7 | 20 | 810 | −48 | — | 750 | 15 | No | CR | Comparative Example |
| 8 | — | — | −45 | 15 | 790 | 19 | Yes | GA | Comparative Example |
| 9 | 51 | 800 | −48 | — | 750 | 25 | Yes | GI | Comparative Example |
| 10 | 10 | 680 | −50 | — | 770 | 15 | Yes | EG | Comparative Example |
| 11 | — | — | −35 | 18 | 815 | 20 | Yes | GA | Comparative Example |
| 12 | — | — | −50 | 52 | 800 | 15 | No | CR | Comparative Example |
| 13 | 10 | 800 | −46 | — | 660 | 20 | No | CR | Comparative Example |
| 14 | — | — | −46 | 10 | 800 | 1 | Yes | EG | Comparative Example |
| 15 | 5 | 820 | −47 | — | 750 | 15 | Yes | GA | Example |
| 16 | — | — | −49 | 10 | 800 | 25 | Yes | GA | Example |
| 17 | — | — | −47 | 10 | 780 | 15 | Yes | GA | Comparative Example |
| 18 | 10 | 820 | −46 | — | 750 | 15 | No | CR | Comparative Example |
| 19 | — | — | −46 | 10 | 780 | 12 | Yes | GI | Comparative Example |
| 20 | 10 | 800 | −42 | — | 760 | 20 | Yes | EG | Example |
| 21 | 20 | 855 | −43 | — | 750 | 25 | No | CR | Example |
| 22 | 15 | 845 | −49 | — | 760 | 25 | Yes | GA | Example |
| 23 | — | — | −46 | 33 | 750 | 15 | Yes | ZAM | Example |
| 24 | — | — | −50 | 10 | 835 | 15 | Yes | GA | Example |
| 25 | 15 | 800 | −48 | — | 750 | 33 | No | CR | Example |
| 26 | — | — | −48 | 20 | 780 | 5 | Yes | GI | Example |
| 27 | 10 | 800 | −47 | — | 720 | 15 | Yes | GA | Example |
| 28 | — | — | −50 | 3 | 750 | 20 | No | CR | Example |
| 29 | 10 | 770 | −48 | — | 770 | 25 | Yes | GA | Example |
| 30 | 2 | 820 | −40 | — | 750 | 12 | No | CR | Example |
| 31 | — | — | −42 | 10 | 830 | 20 | Yes | GI | Example |
| 32 | — | — | −43 | 5 | 800 | 15 | Yes | GA | Example |
| 33 | 5 | 790 | −46 | — | 750 | 18 | Yes | GA | Example |
| 34 | 35 | 800 | −51 | — | 760 | 15 | Yes | GI | Example |
| 35 | — | — | −42 | 15 | 810 | 20 | Yes | GA | Example |

(*) CR: cold-rolled steel sheet (not coated), GI: galvanized steel sheet (not subjected to galvannealing), GA: galvannealed steel sheet, EG: electrogalvanized steel sheet, ZAM: hot-dip zinc-aluminum-magnesium alloy coated steel sheet

*1: Average heating rate in a temperature range of 450° C. to [T1 temperature - 10° C.]

*2: Average cooling rate in a temperature range of [T1 temperature - 10° C.] to 550° C.

The steel sheets and the high-strength coated steel sheets obtained as above were used as sample steels to evaluate their mechanical properties. The mechanical properties were evaluated by the following tensile test. The results are indicated in Table 3. The sheet thickness of the each steel sheet, which is a sample steel sheet, is also indicated in Table 3.

JIS No. 5 test pieces taken so that the longitudinal direction of the test pieces was in three directions, namely, the rolling direction (L direction) of the steel sheet, a direction (D direction) 45° with respect to the rolling direction of the steel sheet, and a direction (C direction) 900 with respect to the rolling direction of the steel sheet, were used to perform a tensile test in accordance with JIS Z 2241 (2011), and the YP (yield stress), the TS (tensile strength), and El (total elongation) were measured. For the purposes of the present invention, the ductility, i.e., El (total elongation), is evaluated as satisfactory when the product, TS× El, was 12,000 MPa % or more. The YR was evaluated as satisfactory when YR=(YP/TS)×100 was as low as 75% or less. The YP planar anisotropy was evaluated as satisfactory when the value of |ΔYP|, which is an index of the YP planar anisotropy, was 50 MPa or less. YP, TS, and El indicated in Table 3 are the measurement results of the test pieces taken in the C direction. |ΔYP| was calculated by the above-described calculation method.

The area fractions of ferrite and martensite, the average crystal grain size of ferrite, the average size of martensite, the average crystal grain size ratio of ferrite to martensite (average crystal grain size of ferrite/average size of martensite) (in Table 3, "size ratio" is indicated), the hardness ratio of martensite to ferrite, and the inverse intensity ratio of the γ-fiber to the α-fiber in the ferrite texture at a position at ¼ of the thickness of the steel sheet were obtained by the methods described above. The rest of the structure was confirmed by a typical method and indicated in Table 3.

The coatability was evaluated as satisfactory when the coating defect length incidence per 100 coils was 0.8% or less. The coating defect length incidence is determined by formula (2) below, and the surface quality was observed with a surface tester and evaluated as "excellent" when the scale defect length incidence per 100 coils was 0.2% or less, "fair" when the incidence was more than 0.2% but not more than 0.8%, and "poor" when the incidence was more than 0.8%.

$$\text{(Coating defect length incidence)} = \text{(total length of defects determined to be coating defects in } L \text{ direction)/(delivery-side coil length)} \times 100 \quad (2)$$

As indicated in Table 3, in Examples of the present invention, TS was 590 MPa or more, the ductility was excellent, the yield ratio (YR) was low, and the YP planar anisotropy and coatability were also excellent. In contrast, in Comparative Examples, at least one of the strength, the YR, the balance between the strength and the ductility, the YP planar anisotropy, and the coatability was poor.

Although the embodiments of the present invention are described heretofore, the present invention is not limited by the description of the embodiments, which constitutes part of the disclosure of the present invention. In other words, other embodiments, examples, and implementation techniques practiced by a person skilled in the art and the like on the basis of the embodiments are all within the scope of the present invention. For example, in a series of heat treatments in the production methods described above, the facilities in which the steel sheet is heat-treated and the like are not particularly limited as long as the heat history conditions are satisfied.

TABLE 3

| No. | Steel type | Sheet thickness (mm) | F area fraction (%) | M area fraction (%) | F average crystal grain size (μm) | M average size (μm) | F-to-M average size ratio | F-to-M hardness ratio | γ-Fiber-to-α-fiber inverse intensity ratio in F |
|---|---|---|---|---|---|---|---|---|---|
| 1 | A | 1.2 | 77.6 | 22.2 | 15.9 | 8.9 | 1.8 | 2.6 | 5.9 |
| 2 | B | 1.6 | 79.9 | 16.0 | 14.3 | 2.6 | 5.5 | 2.1 | 5.0 |
| 3 | C | 1.2 | 68.3 | 8.7 | 12.4 | 9.3 | 1.3 | 3.0 | 5.7 |
| 4 | C | 1.4 | 82.5 | 16.5 | 12.3 | 9.9 | 3.3 | 3.2 | 0.7 |
| 5 | C | 1.2 | 61.8 | 16.4 | 15.9 | 6.7 | 4.0 | 3.5 | 0.6 |
| 6 | C | 1.2 | 74.0 | 21.8 | 16.0 | 4.6 | 3.5 | 2.6 | 0.6 |
| 7 | C | 1.6 | 84.0 | 13.0 | 15.4 | 8.6 | 1.8 | 2.0 | 0.7 |
| 8 | C | 1.5 | 78.3 | 12.5 | 16.6 | 7.2 | 3.0 | 2.6 | 0.7 |
| 9 | C | 1.2 | 17.2 | 76.3 | 5.9 | 16.9 | 0.4 | 0.8 | 3.3 |
| 10 | C | 1.2 | 92.7 | 3.0 | 14.4 | 1.2 | 11.6 | 5.1 | 3.2 |
| 11 | C | 1.4 | 80.5 | 0.4 | 15.4 | 0.6 | 25.2 | 5.9 | 4.5 |
| 12 | C | 1.2 | 17.2 | 72.3 | 5.0 | 17.9 | 0.3 | 0.9 | 6.9 |
| 13 | C | 1.4 | 87.5 | 0.5 | 13.7 | 1.3 | 10.4 | 5.3 | 6.9 |
| 14 | C | 1.2 | 88.6 | 0.4 | 14.2 | 1.1 | 13.0 | 5.4 | 4.0 |
| 15 | D | 1.4 | 78.5 | 11.2 | 12.8 | 9.5 | 1.3 | 1.9 | 4.7 |
| 16 | E | 1.2 | 68.0 | 26.4 | 16.0 | 3.4 | 4.7 | 2.2 | 3.8 |
| 17 | F | 1.6 | 90.6 | 7.0 | 17.0 | 5.5 | 3.1 | 3.6 | 4.9 |
| 18 | G | 1.2 | 89.7 | 6.2 | 16.0 | 4.7 | 3.4 | 3.2 | 3.5 |
| 19 | H | 1.6 | 42.8 | 37.8 | 15.8 | 11.4 | 1.4 | 1.8 | 1.1 |
| 20 | I | 1.0 | 88.6 | 5.7 | 17.2 | 4.2 | 4.1 | 2.5 | 6.6 |
| 21 | J | 1.2 | 72.7 | 23.2 | 15.1 | 2.9 | 5.3 | 2.7 | 3.2 |
| 22 | K | 1.2 | 82.0 | 17.5 | 13.9 | 8.6 | 1.6 | 2.2 | 4.3 |
| 23 | L | 1.4 | 47.4 | 39.9 | 15.6 | 11.3 | 1.4 | 2.5 | 6.0 |
| 24 | M | 1.0 | 46.5 | 35.2 | 11.1 | 10.5 | 1.1 | 1.8 | 3.2 |
| 25 | N | 1.0 | 54.5 | 37.6 | 10.7 | 11.7 | 0.9 | 2.0 | 3.2 |
| 26 | O | 1.8 | 64.2 | 28.7 | 15.3 | 2.5 | 6.1 | 1.7 | 1.4 |
| 27 | P | 1.8 | 79.3 | 18.3 | 11.3 | 9.8 | 1.1 | 2.0 | 6.1 |
| 28 | Q | 1.2 | 92.3 | 5.8 | 14.9 | 10.2 | 1.5 | 2.6 | 4.9 |
| 29 | R | 1.8 | 71.0 | 7.2 | 12.7 | 6.2 | 2.0 | 2.0 | 2.3 |
| 30 | S | 1.2 | 72.0 | 9.3 | 11.5 | 8.4 | 1.4 | 1.9 | 6.2 |
| 31 | T | 1.4 | 84.1 | 7.8 | 10.6 | 2.4 | 4.4 | 2.5 | 4.0 |
| 32 | U | 1.8 | 69.1 | 7.5 | 15.3 | 8.6 | 1.8 | 3.0 | 3.7 |
| 33 | V | 1.4 | 75.8 | 17.9 | 12.3 | 2.3 | 5.3 | 3.1 | 4.0 |
| 34 | W | 1.2 | 77.3 | 12.6 | 13.1 | 6.8 | 1.9 | 2.1 | 6.5 |
| 35 | X | 1.0 | 82.5 | 9.5 | 13.4 | 9.2 | 2.6 | 2.0 | 4.3 |

| No. | Rest of structure | YP (MPa) | TS (MPa) | YR (%) | EI (%) | TS × EI (MPa · %) | \|ΔYP\| (MPa) | Coatability | Remarks |
|---|---|---|---|---|---|---|---|---|---|
| 1 | θ | 454 | 778 | 58 | 18.4 | 14315 | 46 | — | Example |
| 2 | TM + θ | 503 | 799 | 63 | 18.0 | 14382 | 26 | Fair | Example |
| 3 | B + θ | 395 | 619 | 64 | 26.3 | 16280 | 11 | Fair | Example |
| 4 | θ | 380 | 665 | 57 | 21.6 | 14364 | 62 | Fair | Comparative Example |
| 5 | TM + θ | 412 | 660 | 62 | 22.2 | 14652 | 55 | Fair | Comparative Example |
| 6 | TM + θ | 497 | 602 | 83 | 18.0 | 10836 | 42 | Fair | Comparative Example |
| 7 | TM + θ | 367 | 594 | 62 | 19.4 | 11524 | 61 | — | Comparative Example |
| 8 | TM + θ | 407 | 657 | 62 | 22.7 | 14914 | 67 | Fair | Comparative Example |
| 9 | TM + θ | 478 | 599 | 80 | 20.2 | 12100 | 73 | Fair | Comparative Example |

TABLE 3-continued

| | | | | | | | | | |
|---|---|---|---|---|---|---|---|---|---|
| 10 | TM + θ | 435 | 570 | 76 | 26.2 | 14934 | 16 | Fair | Comparative Example |
| 11 | TM + θ | 354 | 571 | 62 | 25.8 | 14732 | 21 | Poor | Comparative Example |
| 12 | θ | 464 | 595 | 78 | 20.9 | 12436 | 76 | — | Comparative Example |
| 13 | TM + θ | 411 | 542 | 76 | 25.7 | 13929 | 38 | — | Comparative Example |
| 14 | P + θ | 378 | 490 | 77 | 24.4 | 11956 | 37 | Fair | Comparative Example |
| 15 | TM + θ | 517 | 795 | 65 | 17.7 | 14072 | 43 | Excellent | Example |
| 16 | TM + θ | 438 | 724 | 60 | 19.5 | 14118 | 36 | Excellent | Example |
| 17 | θ | 332 | 568 | 58 | 25.5 | 14484 | 35 | Excellent | Comparative Example |
| 18 | P + θ | 471 | 575 | 82 | 24.0 | 13800 | 30 | — | Comparative Example |
| 19 | TM + θ | 590 | 752 | 78 | 15.9 | 11957 | 67 | Poor | Comparative Example |
| 20 | θ | 350 | 617 | 57 | 25.9 | 15980 | 18 | Excellent | Example |
| 21 | TM + θ | 382 | 646 | 59 | 22.1 | 14277 | 47 | — | Example |
| 22 | TM + θ | 485 | 780 | 62 | 18.4 | 14352 | 37 | Excellent | Example |
| 23 | P + θ | 413 | 662 | 62 | 20.6 | 13637 | 10 | Excellent | Example |
| 24 | TM + θ | 511 | 785 | 65 | 15.6 | 12246 | 15 | Excellent | Example |
| 25 | B + θ | 549 | 794 | 69 | 16.9 | 13419 | 28 | — | Example |
| 26 | TM + θ | 420 | 720 | 58 | 21.6 | 15552 | 33 | Excellent | Example |
| 27 | TM + θ | 426 | 723 | 59 | 19.5 | 14099 | 18 | Excellent | Example |
| 28 | θ | 369 | 617 | 60 | 27.3 | 16844 | 26 | — | Example |
| 29 | TM + θ | 447 | 755 | 59 | 20.4 | 15402 | 13 | Excellent | Example |
| 30 | TM + θ | 465 | 751 | 62 | 19.2 | 14419 | 40 | — | Example |
| 31 | θ | 459 | 778 | 59 | 18.9 | 14704 | 16 | Excellent | Example |
| 32 | TM + θ | 490 | 794 | 62 | 18.4 | 14610 | 48 | Excellent | Example |
| 33 | TM + θ | 476 | 795 | 60 | 18.9 | 15026 | 23 | Excellent | Example |
| 34 | θ | 463 | 793 | 58 | 18.6 | 14750 | 23 | Excellent | Example |
| 35 | TM + θ | 348 | 716 | 49 | 18.6 | 13708 | 35 | Excellent | Example |

F: ferrite, M: martensite, B: bainite, TM: tempered martensite, P: pearlite, θ: cementite (including alloy carbides)

According to the present invention, production of a high-strength steel sheet having a TS of 590 MPa or more, excellent ductility, a low YR, and excellent YP planar anisotropy, is enabled. Moreover, when the high-strength steel sheet obtained according to the production method of the present invention is applied to, for example, automobile structural elements, fuel efficiency can be improved through car body weight reduction, and thus the present invention offers considerable industrial advantages.

The invention claimed is:

1. A steel sheet comprising:

a composition that contains, in terms of mass %

C: 0.048% or more and 0.200% or less,

Si: 0.40% or less,

Mn: 1.50% or more and 3.00% or less,

P: 0.001% or more and 0.100% or less,

S: 0.0001% or more and 0.0200% or less,

Al: 0.001% or more and 1.000% or less,

N: 0.0005% or more and 0.0100% or less, and the balance being Fe and unavoidable impurities;

a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

2. The steel sheet according to claim 1, wherein the composition further contains, in terms of mass %, at least one element selected from Cr: 0.01% or more and 1.00% or less, Nb: 0.001% or more and 0.100% or less, V: 0.001% or more and 0.100% or less, Ti: 0.001% or more and 0.100% or less, B: 0.0001% or more and 0.0100% or less, Mo: 0.01% or more and 0.50% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

3. The steel sheet according to claim 1, wherein the ratio of a hardness of the martensite to a hardness of the ferrite (martensite hardness/ferrite hardness) is 1.7 or more and 3.1 or less.

4. The steel sheet according to claim 1, wherein the ferrite has an average crystal grain size of 10.6 μm or more and 20 μm or less.

5. A coated steel sheet comprising the steel sheet according to claim 1, having a coating layer on a surface of the steel sheet.

6. A coated steel sheet comprising the steel sheet according to claim 2, having a coating layer on a surface of the steel sheet.

7. A method for producing a steel sheet according to claim 1, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; and coiling the cooled steel sheet under a condition of a coiling temperature of 300° C. or higher and 700° C. or lower; and heating the hot-rolled steel sheet under conditions of a maximum attained temperature of a T1 temperature or higher and a T2 temperature or lower and an average heating rate of 50° C./s or less in a temperature range of 450° C. to [T1 temperature—10° C.];

and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower.

8. A method for producing a steel sheet according to claim 1, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more; and heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower.

9. A method for producing a steel sheet according to claim 1, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a heat-treated steel sheet by heating the hot-rolled steel sheet under conditions of a maximum attained temperature of a T1 temperature or higher and a T2 temperature or lower and an average heating rate of 50° C./s or less in a temperature range of 450° C. to [T1 temperature−10° C.]; and, after the heating, performing cooling and pickling; and re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower.

10. A method for producing a steel sheet according to claim 1, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower; producing a cold-rolled full hard steel sheet by pickling the hot-rolled steel sheet, and cold-rolling the pickled steel sheet at a rolling reduction of 35% or more;

producing a heat-treated steel sheet by heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling; and re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower.

11. A method for producing a steel sheet according to claim 2, the method comprising:

producing a hot-rolled steel sheet by heating a steel slab having a composition that contains, in terms of mass %

C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower; and heating the hot-rolled steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower.

12. A method for producing a steel sheet according to claim 2, the method comprising:

producing a hot-rolled steel sheet by heating a steel slab having a composition that contains, in terms of mass %

C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more; and heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower.

13. A method for producing a steel sheet according to claim 2, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a heat-treated steel sheet by heating the hot-rolled steel sheet obtained in the method under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling; and re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower.

14. A method for producing a steel sheet according to claim 2, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more;

producing a heat-treated steel sheet by heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling; and re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower.

15. A method for producing the coated steel sheet according to claim 5, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; and coiling the cooled steel sheet under a condition of a coiling temperature of 300° C. or higher and 700° C. or lower;

producing a steel sheet by heating the hot-rolled steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

16. A method for producing the coated steel sheet according to claim 5, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more; and producing a steel sheet by heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

17. A method for producing the coated steel sheet according to claim 5, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a heat-treated steel sheet by heating the hot-rolled steel sheet under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling;

producing a steel sheet by re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

18. A method for producing the coated steel sheet according to claim 5, the method comprising:

producing a hot-rolled steel sheet by heating a steel slab having a composition that contains, in terms of mass %
C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more;

producing a heat-treated steel sheet by heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling;

producing a steel sheet by re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

19. A method for producing the coated steel sheet according to claim 6, the method comprising:

producing a hot-rolled steel sheet by heating a steel slab having a composition that contains, in terms of mass %

C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a steel sheet by heating the hot-rolled steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower; and; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad \text{(I)}$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

20. A method for producing the coated steel sheet according to claim 6, the method comprising:

producing a hot-rolled steel sheet by heating a steel slab having a composition that contains, in terms of mass %

C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less;

coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more;

producing a steel sheet by heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and then cooling the heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

21. A method for producing the coated steel sheet according to claim 6, the method comprising:

producing a hot-rolled steel sheet by heating a steel slab having a composition that contains, in terms of mass %

C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a heat-treated steel sheet by heating the hot-rolled steel sheet obtained in the method under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling;

producing a steel sheet by re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

22. A method for producing the coated steel sheet according to claim 6, the method comprising:

producing a hot-rolled steel sheet by heating a steel slab having a composition that contains, in terms of mass %

C: 0.048% or more and 0.200% or less,
Si: 0.40% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less,
at least one element selected from:
Cr: 0.01% or more and 1.00% or less,
Nb: 0.001% or more and 0.100% or less,
V: 0.001% or more and 0.100% or less,
Ti: 0.001% or more and 0.100% or less,
B: 0.0001% or more and 0.0100% or less,
Mo: 0.01% or more and 0.50% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less, and
the balance being Fe and unavoidable impurities;

rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; after the hot-rolling, cooling the hot-rolled steel sheet under a condition of an average cooling rate of 5° C./s or more and 90° C./s or less; coiling the cooled steel sheet under a condition of a coiling temperature of 300° C. or higher and 700° C. or lower;

producing a cold-rolled full hard steel sheet by pickling the hot-rolled steel sheet, and cold-rolling the pickled steel sheet at a rolling reduction of 35% or more;

heating the cold-rolled full hard steel sheet under conditions of a maximum attained temperature of a T1 temperature or higher and a T2 temperature or lower and an average heating rate of 50° C./s or less in a temperature range of 450° C. to [T1 temperature—10° C.]; and, after the heating, performing cooling and pickling;

producing a steel sheet by re-heating the heat-treated steel sheet to a temperature equal to or higher than the T1 temperature; and cooling the re-heated steel sheet under a condition of an average cooling rate of 3° C./s or more in a temperature range of [T1 temperature—10° C.] to 550° C., wherein a dew point in a temperature range of 600° C. or higher is −40° C. or lower; and coating the steel sheet comprising a microstructure containing, in terms of area fraction, 20% or more and 86% or less of ferrite and 5% or more of martensite, wherein the ferrite has an average crystal grain size of 5.0 μm or more and 20 μm or less, the martensite has an average size of 15 μm or less, a ratio of the average crystal grain size of the ferrite to the average size of the martensite (ferrite average crystal grain size/martensite average size) is 0.5 to 10.0, a ratio of a hardness of the martensite to a hardness of the ferrite (martensite hardness/ferrite hardness) is 1.0 or more and 5.0 or less, and, in a texture of the ferrite, an inverse intensity ratio of γ-fiber to α-fiber is 0.8 or more and 7.0 or less; and a tensile strength of 780 MPa or more, a yield ratio of 65% or less, and an index of the YP planar anisotropy |ΔYP| of 50 MPa or less, wherein the index of the YP planar anisotropy |ΔYP| is determined by formula (1) below:

$$\Delta YP=(YPL-2\times YPD+YPC)/2 \quad (I)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

* * * * *